US009202660B2

(12) United States Patent
Goren et al.

(10) Patent No.: US 9,202,660 B2
(45) Date of Patent: Dec. 1, 2015

(54) ASYMMETRICAL SLOW WAVE STRUCTURES TO ELIMINATE BACKWARD WAVE OSCILLATIONS IN WIDEBAND TRAVELING WAVE TUBES

(71) Applicant: Teledyne Wireless, LLC, Thousand Oaks, CA (US)

(72) Inventors: Yehuda G. Goren, Scotts Valley, CA (US); Tong Chen, Palo Alto, CA (US)

(73) Assignee: TELEDYNE WIRELESS, LLC, Thousand Oaks, CA (US)

( * ) Notice: Subject to any disclaimer, the term of this patent is extended or adjusted under 35 U.S.C. 154(b) by 135 days.

(21) Appl. No.: 13/799,953

(22) Filed: Mar. 13, 2013

(65) Prior Publication Data

US 2014/0265826 A1 Sep. 18, 2014

(51) Int. Cl.

| | |
|---|---|
| ***H01J 23/30*** | (2006.01) |
| ***H01J 23/24*** | (2006.01) |
| ***H01J 25/36*** | (2006.01) |
| *H01J 25/44* | (2006.01) |

(52) U.S. Cl.

CPC ..... *H01J 23/24* (2013.01); *H01J 23/30* (2013.01); *H01J 25/36* (2013.01); *H01J 25/44* (2013.01)

(58) Field of Classification Search

CPC ..... H01J 23/24; H01J 23/26; H01J 23/28; H01J 23/30; H01J 25/34; H01J 25/36

USPC ..... 315/3.5, 39.3

See application file for complete search history.

(56) References Cited

U.S. PATENT DOCUMENTS

| | | | | |
|---|---|---|---|---|
| 2,111,412 | A | | 3/1938 | Ungelenk |
| 2,493,606 | A | | 1/1950 | Waterton |
| 2,687,777 | A | | 8/1954 | Warnecke et al. |
| 2,706,366 | A | | 4/1955 | Best |
| 2,718,622 | A | | 9/1955 | Harkless |
| 2,812,467 | A | * | 11/1957 | Kompfner ..... 315/3.5 |
| 2,922,919 | A | * | 1/1960 | Bruck ..... 315/3.6 |
| 2,939,952 | A | | 6/1960 | Paul et al. |
| 2,950,389 | A | | 8/1960 | Paul et al. |
| 2,976,454 | A | | 3/1961 | Birdsall |

(Continued)

FOREIGN PATENT DOCUMENTS

| | | |
|---|---|---|
| CH | 260999 | 8/1949 |
| DE | 965048 | 5/1957 |

(Continued)

OTHER PUBLICATIONS

"400 MSPS 14-Bit, 1.8 V CMOS, Direct Digital Synthesizer", AD9954, Analog Devices, 2003, 34 pages.

(Continued)

*Primary Examiner* — Benny Lee

(74) *Attorney, Agent, or Firm* — K&L Gates LLP

(57) ABSTRACT

In various embodiments, a traveling wave amplifier circuit is disclosed. The traveling wave amplifier circuit is configured to receive an RF wave and an electron beam. The traveling wave amplifier effects synchronized interaction between the RF wave and the electron beam. The traveling wave amplifier circuit comprises a waveguide. The waveguide comprises a plurality of asymmetric cells arranged periodically. The waveguide is configured to receive an electron beam. Each of the asymmetric cells comprises at least one asymmetrical structure within the asymmetric cell to modify the dispersion relation of the waveguide.

19 Claims, 25 Drawing Sheets

(56) References Cited

U.S. PATENT DOCUMENTS 3,065,640 A 11/1962 Langmuir et al.
3,089,975 A * 5/1963 Washburn, Jr. ..... 315/3.6
3,119,969 A 1/1964 Ducot et al.
3,241,091 A * 3/1966 Laures ..... 333/156
3,243,735 A 3/1966 Gross
3,260,875 A 7/1966 Evans
3,300,677 A 1/1967 Karol et al.
3,310,864 A 3/1967 MacKerrow
3,334,225 A 8/1967 Langmuir
3,366,897 A * 1/1968 Konrad ..... 333/162
3,387,169 A 6/1968 Farney
3,423,638 A 1/1969 Dix et al.
3,443,146 A * 5/1969 Buck ..... 315/3.5
3,453,711 A 7/1969 Miller
3,541,467 A 11/1970 Seidel
3,546,511 A 12/1970 Shimula
3,564,124 A 2/1971 Popovich
3,612,880 A 10/1971 Lansiart
3,617,740 A 11/1971 Skillicorn
3,624,678 A 11/1971 Falce
3,688,222 A 8/1972 Lieberman
3,696,324 A 10/1972 Baum
3,716,745 A 2/1973 Phillips
3,748,729 A 7/1973 Bottcher et al.
3,753,140 A 8/1973 Feistel
3,755,717 A 8/1973 Shaw
3,780,334 A 12/1973 Leboutet
3,796,965 A 3/1974 Quesinberry et al.
3,873,889 A 3/1975 Leyba
3,886,470 A 5/1975 O'Neil et al.
3,893,048 A 7/1975 Lieberman
3,900,823 A 8/1975 Sokal et al.
3,946,341 A 3/1976 Chiron et al.
3,955,161 A 5/1976 MacTurk
3,956,712 A 5/1976 Hant
4,000,471 A 12/1976 Pankow
4,004,253 A 1/1977 Takasaki et al.
4,016,515 A 4/1977 Wauk, II
4,034,319 A 7/1977 Olsson
4,035,747 A 7/1977 Hindermayr et al.
4,037,182 A 7/1977 Burnett et al.
4,053,855 A 10/1977 Kivi et al.
4,059,815 A 11/1977 Makimoto et al.
4,061,944 A 12/1977 Gay
4,100,450 A 7/1978 Frutiger et al.
4,126,370 A 11/1978 Nijman
4,134,114 A 1/1979 Riggs et al.
4,165,472 A 8/1979 Wittry
4,184,123 A 1/1980 Grill et al.
4,197,540 A 4/1980 Riggs et al.
4,216,448 A 8/1980 Kasuga et al.
4,233,539 A 11/1980 Falce
4,258,328 A 3/1981 Prevot et al.
4,267,516 A 5/1981 Traa
4,270,069 A 5/1981 Wiehler
4,276,514 A 6/1981 Huang
4,278,957 A 7/1981 Starai et al.
4,292,610 A 9/1981 Makimoto et al.
4,304,978 A 12/1981 Saunders
4,309,677 A 1/1982 Goldman
4,359,666 A 11/1982 Tornoe
4,376,927 A 3/1983 McGalliard
4,379,741 A 4/1983 Sano et al.
4,382,238 A 5/1983 Makimoto et al.
4,406,770 A 9/1983 Chan et al.
4,412,272 A 10/1983 Wedertz et al.
4,431,977 A 2/1984 Sokola et al.
4,446,445 A 5/1984 Apel
4,455,504 A 6/1984 Iversen
4,488,128 A 12/1984 Odozynski
4,495,640 A 1/1985 Frey
4,506,241 A 3/1985 Makimoto et al.
4,510,551 A 4/1985 Brainard, II
4,532,478 A 7/1985 Silagi
4,540,884 A 9/1985 Stafford et al.
4,540,954 A 9/1985 Apel
4,554,514 A 11/1985 Whartenby et al.
4,560,829 A 12/1985 Reed et al.
4,577,340 A 3/1986 Carlson et al.
4,581,595 A 4/1986 Silagi
4,583,049 A 4/1986 Powell
4,584,699 A 4/1986 LaFiandra et al.
4,586,009 A * 4/1986 James ..... 333/156
4,595,882 A 6/1986 Silagi et al.
4,600,892 A 7/1986 Wagner et al.
4,622,687 A 11/1986 Whitaker et al.
4,625,533 A 12/1986 Okada et al.
4,629,996 A 12/1986 Watanabe et al.
4,631,506 A 12/1986 Makimoto et al.
4,664,769 A 5/1987 Cuomo et al.
4,688,239 A 8/1987 Schaffner et al.
4,701,717 A 10/1987 Radermacher et al.
4,721,933 A 1/1988 Schwartz et al.
4,727,641 A 3/1988 Kanatani et al.
4,728,846 A 3/1988 Yasuda
4,730,173 A 3/1988 Tsunoda
4,733,208 A 3/1988 Ishikawa et al.
4,736,101 A 4/1988 Syka et al.
4,739,448 A 4/1988 Rowe et al.
4,740,765 A 4/1988 Ishikawa et al.
4,749,860 A 6/1988 Kelley et al.
4,761,545 A 8/1988 Marshall et al.
4,771,172 A 9/1988 Weber-Grabau et al.
4,779,056 A 10/1988 Moore et al.
4,788,705 A 11/1988 Anderson
4,792,879 A 12/1988 Bauknecht et al.
4,818,869 A 4/1989 Weber-Grabau
4,828,022 A 5/1989 Koehler et al.
4,841,179 A 6/1989 Hagino et al.
4,882,484 A 11/1989 Franzen et al.
4,885,551 A 12/1989 Myer
4,890,077 A 12/1989 Sun
4,891,615 A 1/1990 Komazaki et al.
4,897,609 A 1/1990 Mallavarpu
4,899,354 A 2/1990 Reinhold
4,907,065 A 3/1990 Sahakian
4,928,206 A 5/1990 Porter et al.
4,928,296 A 5/1990 Kadambi
4,959,705 A 9/1990 Lemnios et al.
4,967,169 A 10/1990 Sun et al.
4,967,260 A 10/1990 Butt
4,974,057 A 11/1990 Tazima
4,975,577 A 12/1990 Franzen et al.
4,982,088 A 1/1991 Weitekamp et al.
4,985,690 A 1/1991 Eguchi et al.
4,988,392 A 1/1991 Nicholson et al.
4,990,948 A 2/1991 Sasaki et al.
5,021,743 A 6/1991 Chu et al.
5,030,933 A 7/1991 Ikeda
5,045,971 A 9/1991 Ono et al.
5,055,966 A 10/1991 Smith et al.
5,056,127 A 10/1991 Iversen et al.
5,065,110 A 11/1991 Ludvik et al.
5,065,123 A 11/1991 Heckaman et al.
5,075,547 A 12/1991 Johnson et al.
5,097,318 A 3/1992 Tanaka et al.
5,126,633 A 6/1992 Avnery et al.
5,128,542 A 7/1992 Yates et al.
5,134,286 A 7/1992 Kelley
5,144,268 A 9/1992 Weidman
5,148,117 A 9/1992 Talwar
5,166,649 A 11/1992 Aizawa et al.
5,170,054 A 12/1992 Franzen
5,173,672 A 12/1992 Heine
5,173,931 A 12/1992 Pond
5,182,451 A 1/1993 Schwartz et al.
5,182,524 A 1/1993 Hopkins
5,196,699 A 3/1993 Kelley
5,198,665 A 3/1993 Wells
5,200,613 A 4/1993 Kelley
5,250,916 A 10/1993 Zakman
5,274,233 A 12/1993 Kelley
5,285,063 A 2/1994 Schwartz et al.
5,291,062 A 3/1994 Higgins, III

(56) References Cited

U.S. PATENT DOCUMENTS 5,291,158 A 3/1994 Blair et al.
5,295,175 A 3/1994 Pond
5,300,791 A 4/1994 Chen et al.
5,302,826 A 4/1994 Wells
5,311,059 A 5/1994 Banerji et al.
5,311,402 A 5/1994 Kobayashi et al.
5,319,211 A 6/1994 Matthews et al.
5,329,687 A 7/1994 Scott et al.
5,334,295 A 8/1994 Gallagher et al.
5,336,390 A 8/1994 Busack et al.
5,355,283 A 10/1994 Marrs et al.
5,372,696 A 12/1994 Kiesele et al.
5,378,898 A 1/1995 Schonberg et al.
5,389,903 A 2/1995 Piirainen
5,395,507 A 3/1995 Aston et al.
5,404,273 A 4/1995 Akagawa
5,438,686 A 8/1995 Gehri et al.
5,457,269 A 10/1995 Schonberg et al.
5,468,159 A 11/1995 Brodsky et al.
5,477,081 A 12/1995 Nagayoshi
5,483,074 A 1/1996 True
5,493,074 A 2/1996 Murata et al.
5,495,215 A 2/1996 Newell et al.
5,498,487 A 3/1996 Ruka et al.
5,500,621 A 3/1996 Katz et al.
5,523,577 A 6/1996 Schonberg et al.
5,525,864 A 6/1996 Butler et al.
5,528,203 A 6/1996 Mohwinkel et al.
5,529,959 A 6/1996 Yamanaka
5,541,975 A 7/1996 Anderson et al.
5,557,163 A 9/1996 Wakalopulos
5,561,085 A 10/1996 Gorowitz et al.
5,576,660 A 11/1996 Pouysegur et al.
5,576,673 A 11/1996 Asija
5,578,869 A 11/1996 Hoffman et al.
5,598,034 A 1/1997 Wakefield
5,608,331 A 3/1997 Newberg et al.
5,612,257 A 3/1997 Tsemg et al.
5,612,588 A 3/1997 Wakalopulos
5,614,442 A 3/1997 Tsemg
5,621,270 A 4/1997 Allen
5,623,123 A 4/1997 Umehars
5,627,871 A 5/1997 Wang
5,635,762 A 6/1997 Gamand
5,644,169 A 7/1997 Chun
5,668,512 A 9/1997 Mohwinkel et al.
5,675,288 A 10/1997 Peyrotte et al.
5,682,412 A 10/1997 Skillicorn et al.
5,696,473 A 12/1997 Tsujiguchi et al.
5,705,959 A 1/1998 O'Loughlin
5,708,283 A 1/1998 Wen et al.
5,719,539 A 2/1998 Ishizaki et al.
5,723,904 A 3/1998 Shiga
5,728,289 A 3/1998 Kirchnavy et al.
5,736,783 A 4/1998 Wein et al.
5,737,387 A 4/1998 Smither
5,742,002 A 4/1998 Arredondo et al.
5,742,201 A 4/1998 Eisenberg et al.
5,742,204 A 4/1998 Bell
5,742,214 A 4/1998 Toda et al.
5,748,058 A 5/1998 Scott
5,749,638 A 5/1998 Cornelissen et al.
5,753,857 A 5/1998 Choi
5,758,001 A 5/1998 Ionov
5,760,646 A 6/1998 Belcher et al.
5,760,650 A 6/1998 Faulkner et al.
5,761,317 A 6/1998 Pritchard
5,783,900 A 7/1998 Humphries, Jr. et al.
5,789,852 A 8/1998 Cornelissen et al.
5,796,211 A 8/1998 Graebner et al.
5,818,692 A 10/1998 Denney, Jr. et al.
5,825,195 A 10/1998 Hembree et al.
5,830,337 A 11/1998 Xu
5,832,598 A 11/1998 Greenman et al.
5,835,355 A 11/1998 Dordi
5,838,195 A 11/1998 Szmurto et al.
5,847,453 A 12/1998 Uematsu et al.
5,861,777 A 1/1999 Sigmon et al.
5,877,560 A 3/1999 Wen et al.
5,886,248 A 3/1999 Paulus et al.
5,903,239 A 5/1999 Takahashi et al.
5,909,032 A 6/1999 Wakalopulos
5,910,753 A 6/1999 Bogdan
5,915,213 A 6/1999 Iwatsuki et al.
5,930,688 A 7/1999 Floyd et al.
5,932,926 A 8/1999 Maruyama et al.
5,940,025 A 8/1999 Koehnke et al.
5,942,092 A 8/1999 Weyl et al.
5,945,734 A 8/1999 McKay
5,949,140 A 9/1999 Nishi et al.
5,962,995 A 10/1999 Avnery
5,982,233 A 11/1999 Hellmark et al.
5,986,506 A 11/1999 Oga
5,990,735 A 11/1999 Sigmon et al.
5,990,757 A 11/1999 Tonomura et al.
5,990,763 A 11/1999 Sipilä
5,998,817 A 12/1999 Wen et al.
5,998,862 A 12/1999 Yamanaka
5,998,877 A 12/1999 Ohuchi
6,008,534 A 12/1999 Fulcher
6,020,629 A 2/2000 Farnworth et al.
6,024,618 A 2/2000 Makishima et al.
6,069,027 A 5/2000 Mertol et al.
6,087,716 A 7/2000 Ikeda
6,099,708 A 8/2000 Mallory et al.
6,124,636 A 9/2000 Kusamitsu
6,137,168 A 10/2000 Kirkman
6,140,710 A 10/2000 Greenberg
6,157,080 A 12/2000 Tamaki et al.
6,157,085 A 12/2000 Terashima
6,169,323 B1 1/2001 Sakamoto
6,177,836 B1 1/2001 Young et al.
6,225,696 B1 5/2001 Hathaway et al.
6,255,767 B1 7/2001 Lee et al.
6,274,927 B1 8/2001 Glenn
6,285,254 B1 9/2001 Chen et al.
6,305,214 B1 10/2001 Schattke et al.
6,320,543 B1 11/2001 Ohata et al.
6,353,257 B1 3/2002 Huang
6,358,773 B1 3/2002 Lin et al.
6,359,476 B2 3/2002 Hartman et al.
6,381,380 B1 4/2002 Forrest et al.
6,400,415 B1 6/2002 Danielsons
6,404,291 B1 6/2002 Riley
6,407,492 B1 6/2002 Avnery et al.
6,414,849 B1 7/2002 Chiu
6,441,692 B1 8/2002 Nakatani et al.
6,443,632 B2 9/2002 Ando et al.
6,459,337 B1 10/2002 Goren et al.
6,462,413 B1 10/2002 Polese et al.
6,507,110 B1 1/2003 Chen et al.
6,515,525 B2 2/2003 Hasegawa
6,545,398 B1 4/2003 Avnery
6,549,765 B2 4/2003 Welland et al.
6,553,089 B2 4/2003 Huh et al.
6,566,748 B1 5/2003 Shimizu et al.
6,570,452 B2 5/2003 Sridharan
6,590,450 B2 7/2003 Chen et al.
6,593,783 B2 7/2003 Ichimaru
6,597,250 B2 7/2003 Jovenin
6,600,378 B1 7/2003 Patana
6,603,360 B2 8/2003 Kim et al.
6,608,529 B2 8/2003 Franca-Neto
6,622,010 B1 9/2003 Ichimaru
6,630,774 B2 10/2003 Avnery
6,674,229 B2 1/2004 Avnery et al.
6,714,113 B1 3/2004 Abadeer et al.
6,731,015 B2 5/2004 Wu et al.
6,750,461 B2 6/2004 Fink et al.
6,870,320 B2 3/2005 Ratzinger et al.
7,026,749 B2 4/2006 Rho et al.
7,446,601 B2 11/2008 LeChavalier
8,179,045 B2 5/2012 Goren et al.
2002/0030269 A1 3/2002 Ammar

(56) References Cited

U.S. PATENT DOCUMENTS

| | | | |
|---|---|---|---|
| 2002/0093379 | A1 | 7/2002 | Goren et al. |
| 2003/0021377 | A1 | 1/2003 | Turner et al. |
| 2003/0058961 | A1 | 3/2003 | Fling et al. |
| 2003/0132529 | A1 | 7/2003 | Yeo et al. |
| 2003/0151133 | A1 | 8/2003 | Kinayman et al. |
| 2004/0223575 | A1 | 11/2004 | Meltzer et al. |
| 2005/0077973 | A1 | 4/2005 | Dayton, Jr. |
| 2009/0096378 | A1 | 4/2009 | Barnett et al. |
| 2009/0261925 | A1 | 10/2009 | Goren et al. |
| 2012/0321246 | A1 | 12/2012 | Pomerene et al. |

FOREIGN PATENT DOCUMENTS

| | | | |
|---|---|---|---|
| DE | 2653856 | B1 | 2/1978 |
| DE | 3438382 | A1 | 4/1986 |
| EP | 0148706 | A2 | 7/1985 |
| EP | 0180328 | A1 | 5/1986 |
| EP | 0205399 | A2 | 12/1986 |
| EP | 0293791 | A1 | 7/1988 |
| EP | 0331289 | A2 | 9/1989 |
| EP | 0336990 | A1 | 10/1989 |
| EP | 0350159 | A1 | 1/1990 |
| EP | 0377519 | A | 7/1990 |
| EP | 0383961 | A1 | 8/1990 |
| EP | 0393584 | A2 | 10/1990 |
| EP | 0411180 | A1 | 2/1991 |
| EP | 491161 | A1 | 6/1992 |
| EP | 0524011 | A2 | 1/1993 |
| EP | 0617465 | A1 | 9/1994 |
| EP | 0639747 | A1 | 2/1995 |
| EP | 0641035 | A2 | 3/1995 |
| EP | 0786660 | A2 | 7/1997 |
| GB | 760555 | | 10/1956 |
| GB | 984607 | | 2/1965 |
| GB | 1302605 | | 1/1973 |
| GB | 1507458 | | 4/1978 |
| GB | 1519456 | | 7/1978 |
| GB | 2018171 | A | 10/1979 |
| GB | 2143237 | A | 2/1985 |
| GB | 2178540 | A | 2/1987 |
| GB | 2271471 | A | 4/1994 |
| GB | 2326485 | A | 12/1998 |
| JP | 56-107601 | A | 8/1981 |
| JP | 58-19001 | A | 2/1983 |
| JP | 58-178602 | A | 10/1983 |
| JP | 1-73903 | | 7/1989 |
| JP | 01-173777 | | 7/1989 |
| JP | 1-283074 | | 11/1989 |
| JP | 02-226801 | | 9/1990 |
| JP | 3-48448 | | 3/1991 |
| JP | 03-187247 | | 8/1991 |
| JP | 61-51946 | A | 5/1994 |
| JP | 6-204705 | | 7/1994 |
| JP | 61-99629 | A | 7/1994 |
| JP | 08-237007 | | 9/1996 |
| WO | WO 82/03522 | A1 | 10/1982 |
| WO | WO 83/02850 | A1 | 8/1983 |
| WO | WO 93/01625 | A1 | 1/1993 |
| WO | WO 93/24968 | A1 | 12/1993 |
| WO | WO 97/17738 | A1 | 5/1997 |
| WO | WO 97/17755 | A1 | 5/1997 |
| WO | WO 99/22229 | A1 | 5/1999 |
| WO | WO 00/07239 | A1 | 2/2000 |

OTHER PUBLICATIONS

"RF PLL Frequency Synthesizers", ADF4110-ADF4111-ADF4112-ADF4113, Analog Devices, 2003, 24 pages.

Burggraaf, "Chip scale and flip chip: Attractive Solutions", Solid State Technology, Jul. 1998, 5 pages.

Filtronic publication, Filtronic Components Limited, Sub Systems Division, West Yorkshire, England, 1994—2 pages.

K&L Microwave Incorporated, A Dover Technologies Company, Salisbury, England, 1988—2 pages.

Krems, et al., "Avoiding Cross Talk and Feed Back Effects in Packaging Coplanar Millimeter-Wave Circuits", WE4B-3, IEEE MTT-S Digest, 1998, pp. 1091-1094.

Lieberman et al., "1974 IEEE International Solid State Circuits Conference", pp. 100-101, 235.

Gunston, Microwave Transmission-Line Impedance Data, London, 1972, p. 52.

Makimoto et al., "Compact Bandpass Filters Using Stepped Impedance Resonators," Proceedings of the IEEE, vol. 67, No. 1, Jan. 1979, pp. 16-19.

Matthaei, et al., "Microwave Filters, Impedance Matching Networks and Coupling Structures", Dedham, MA, pp. 355-380.

Moore et al., "1980 Ultrasonic Symposium", pp. 838-841.

Muhonen et al., "Amplifier Linearization for the Local Multipoint Distribution System Application," IEEE Personal, Mobile, Indoor and Radio Communication Conference, Boston, MA, 6 pages, Sep. 1998.

Ohiso, et al., "Flip-Chip Bonded 0.85-μm Bottom-Emitting Vertical-Cavity Laser Array on an A1GaAs Substrate", IEEE Photonics Technology Letters, vol. 8, No. 9, Sep. 1996, pp. 1115-1117.

Okeans, et al., "Properties of a Tem Transmission Line Used in Microwave Integrated Circuit Applications", Transactions of the IEEE, MIT-15, May 1967, pp. 327-328.

Peter, "Solder Flip-Chip and CSP Assembly System", Chip Scale Review, Jul./Aug. 1999, pp. 58-62.

Reeder et al., IEEE Transactions on Microwave Theory and Techniques, No. 11, Nov. 1969, pp. 927-941.

Sagawa et al., "Geometrical Structures and Fundamental Characteristics of Microwave Stepped Impedance Resonators," IEEE Transactions on Microwave Theory and Techniques, vol. 45, No. 7, Jul. 1997, pp. 1078-1085.

Sakai et al. "A Novel Millimeter-Wave IC on Si Substrate Using Flip-Chip Bonding Technology", IEICE Trans. Electron, vol. E78-C., No. 8, Aug. 1995, pp. 971-978.

Sundelin et al., "1979 Ultrasonic Symposium, IEEE", pp. 161-164.

Wadsworth, et al., "Flip Chip GaAs MMICs for Microwave MCM-D Applications", Advancing Microelectronics, May/Jun. 1998, pp. 22-25.

Wolf et al. "Silicon Processing for the VLSI era, vol. 1: Process Technology," Lattice Press, 2000, pp. 846-851, 863-865.

Shin et al., "Intense wideband terahertz amplification using phase shifted periodic electron-plasmon coupling", Applied Physics Letters 92, 2008, 091501-1 to 091501-3.

Srivastava, "THz Vacuum Microelectronic Devices", Journal of Physics: Conference Series 114 (2008) 012015, 10 pages.

Carlsten et al., "Technology Development for a mm-Wave Sheet-Beam Traveling-Wave Tube", IEEE Transactions on Plasma Science, vol. 33, No. 1, Feb. 2005, pp. 85-93.

Krawczyk et al., "Design of a 300 GHZ Broadband TWT Coupler and RF-Structure", Proceedings of LINAC 2004, Lubeck, Germany, pp. 794-796.

* cited by examiner

ASYMMETRICAL SLOW WAVE STRUCTURES TO ELIMINATE BACKWARD WAVE OSCILLATIONS IN WIDEBAND TRAVELING WAVE TUBES

BACKGROUND

Backward-wave oscillation in traveling wave-tube amplifiers has been a problem since the development of traveling wave tubes in the 1940s. Traveling wave-tube amplifiers are configured to affect interaction between an input radio frequency (RF) wave and an input electron beam. Backward wave oscillation occurs when a reflected RF wave traveling towards the input interacts with the electron beam. The backward wave is amplified and causes oscillation of the traveling wave-tube amplifier. Backward-wave oscillation limits the operational bandwidth of traveling wave-tube amplifiers to a fraction of the theoretical bandwidth as well as its output power.

Various solutions have been attempted to limit the backward-wave oscillation of traveling wave amplifiers. For example, attenuation sections may be added to the traveling wave-tube amplifier to cause attenuation of the backward wave. However, this attenuation also affects the forward wave, and therefore the length of the traveling wave-tube amplifier circuit must be increased to compensate. The lengthening of the traveling wave-tube amplifier creates further backward wave oscillation. Also, from thermal considerations, the attenuations are limited to the traveling wave-tube gain sections and not to the power output section. The existing techniques for limiting backward-wave oscillation still result in loss of bandwidth and provide less efficiency as the power of the input wave is increased.

SUMMARY OF INVENTION

In various embodiments, a traveling wave amplifier circuit is disclosed. The traveling wave amplifier circuit is configured to receive an RF wave and an electron beam. The traveling wave amplifier effects synchronized interaction between the RF wave and the electron beam. The traveling wave amplifier circuit comprises a waveguide. The waveguide comprises a plurality of asymmetric cells arranged periodically. The waveguide is configured to receive an electron beam. The waveguide affects interaction between the RF input wave and the electron beam. Each of the asymmetric cells comprises at least one asymmetrical structure within the asymmetric cell to modify the dispersion relation of the waveguide.

In various embodiments, a traveling wave tube amplifier is disclosed. The traveling wave tube amplifier comprises a waveguide. The waveguide comprises a plurality of asymmetric cells arranged periodically. The waveguide is configured to receive an electron beam. Each asymmetric cell comprises at least one asymmetrical structure within the asymmetric cell to modify the dispersion relation of the waveguide. The modified dispersion relation prevents backward-wave oscillation in the waveguide. The traveling wave tube amplifier further comprises an electron beam input device configured to generate the electron beam in the waveguide. The waveguide is configured to slow a wave velocity of an input radiofrequency beam to match an input velocity of the electron beam.

BRIEF DESCRIPTION OF THE DRAWINGS

The features of the various embodiments are set forth with particularity in the appended claims. The various embodiments, however, both as to organization and methods of operation, together with advantages thereof, may best be understood by reference to the following description, taken in conjunction with the accompanying drawings as follows:

DETAILED DESCRIPTION OF THE INVENTION

In various embodiments, a traveling wave amplifier circuit is disclosed. The traveling wave amplifier circuit is configured to receive an RF wave and an electron beam. The traveling wave amplifier effects synchronized interaction between the RF wave and the electron beam. The traveling wave amplifier circuit comprises a waveguide. The waveguide comprises a plurality of asymmetric cells arranged periodically. The waveguide is configured to receive an electron beam. The waveguide affects interaction between the RF input way and the electron beam. Each of the asymmetric cells comprises at least one asymmetrical structure within the asymmetric cell to modify the dispersion relation of the waveguide.

In various embodiments, a traveling wave tube amplifier is disclosed. The traveling wave tube amplifier comprises a waveguide. The waveguide comprises a plurality of asymmetric cells arranged periodically. The waveguide is configured to receive an electron beam. Each asymmetric cell comprises at least one asymmetrical structure within the asymmetric cell to modify the dispersion relation of the waveguide. The modified dispersion relation prevents backward-wave oscillation in the waveguide. The traveling wave tube amplifier further comprises an electron beam input device configured to generate the electron beam in the waveguide. The waveguide is configured to slow a wave velocity of an input radiofrequency beam to match an input velocity of the electron beam.

Reference will now be made in detail to several embodiments, including embodiments showing example implementations of asymmetrical slow wave structures. Wherever practicable similar or like reference numbers may be used in the figures and may indicate similar or like functionality. The figures depict example embodiments of the disclosed systems and/or methods of use for purposes of illustration only. One skilled in the art will readily recognize from the following description that alternative example embodiments of the structures and methods illustrated herein may be employed without departing from the principles described herein.

Figure 1A:
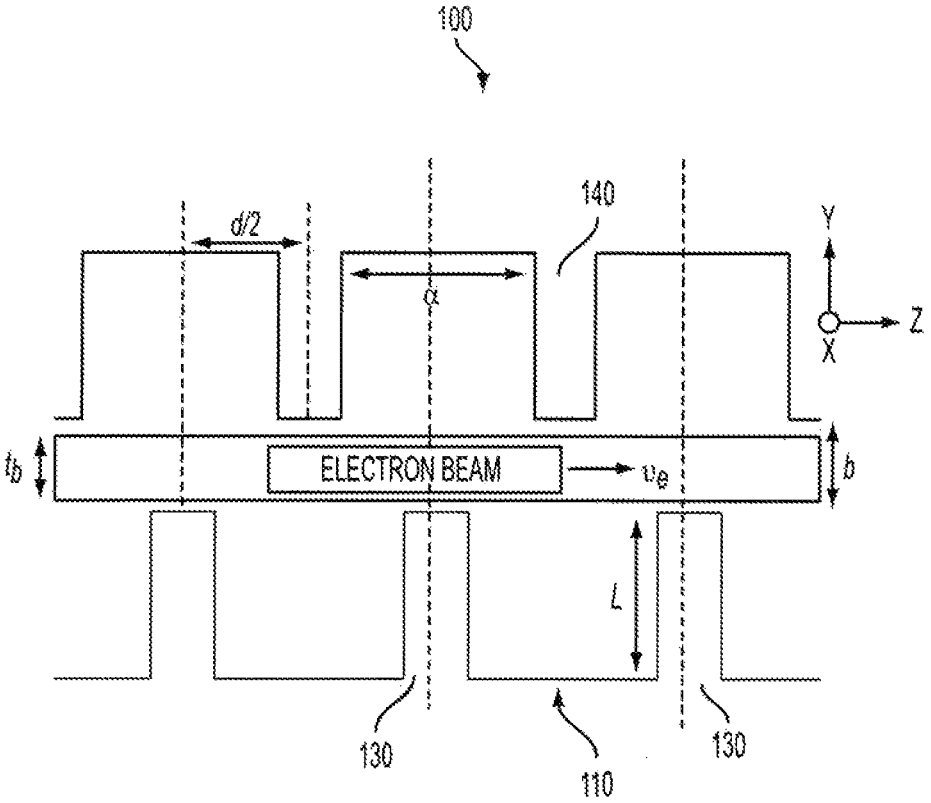
FIGS. 1A-1C illustrate one embodiment of a symmetric waveguide structure.
Figure 1B:
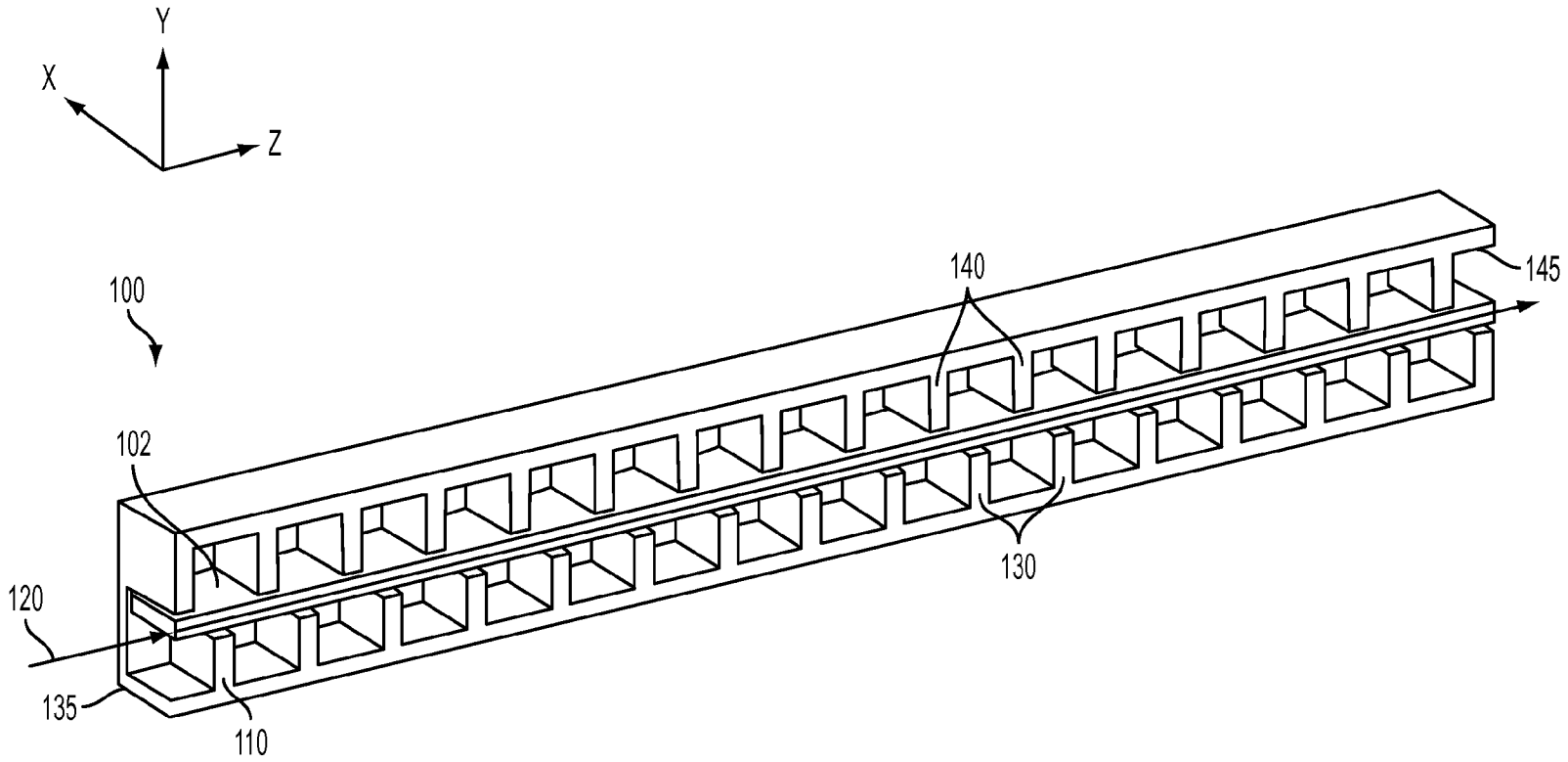
Figure 1C:
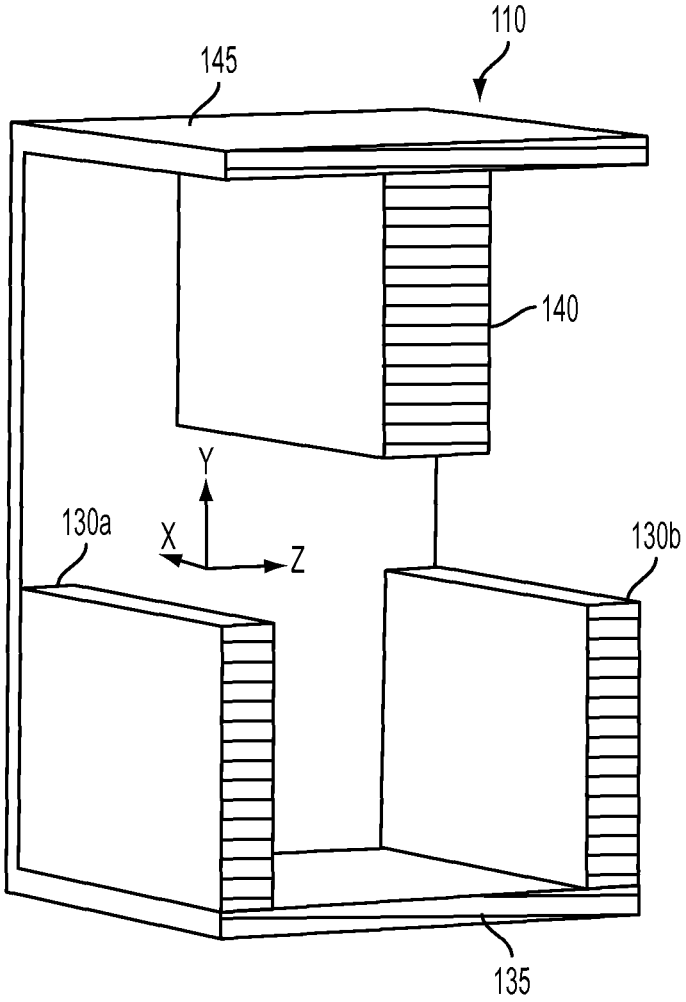

FIGS. 1A-1C illustrate one embodiment of a symmetrical slow wave structure (SWS) on with reference to coordinate system X, Y, Z. With reference now to FIG. 1A, a plurality of periodic symmetric cells 110 of a symmetric waveguide 100 is shown arranged along the Z-Y plane where the X axis is shown into the page and the Z-Y plane is shown on the page. Each of the periodic symmetric cells 110 comprises first projections 130 and second projections 140 along the Y axis. The first projections 130 and the second projections 140 may be separated by a distance d/2. The symbol $t_b$ indicates a beam thickness of the electron beam and b indicates a tunnel gap (which is the gap in which the electron beam moves with a velocity $v_e$). The second projection 140 is located symmetrically between pairs of first projections 130. The ELECTRON BEAM moves in the Z direction at a velocity $v_e$. The height of the first projections 130 along the Y axis is defined by L. The distance between a pair of second projections 140 is $\alpha$. With reference now to FIG. 1B, a perspective cut-away side view of one embodiment of an electron sheet beam amplifier circuit is shown along axes X, Y, and Z. The circuit may comprises a slow wave structure (SWS), such as a symmetric waveguide 100, for slowing the wave velocity of an input radiofrequency (RF) wave to match the wave velocity of an input electron beam, such as, for example, the input electron sheet beam 102. The electron sheet beam 102 may be generated using any suitable sheet beam electron gun, for example. Synchronous interaction between the velocity-matched RF wave and the electron beam 102 affects a transfer of energy from the electron beam 102 to the RF wave, thus increasing the power of the input RF wave. The waveguide 100 may comprise a plurality of periodic cells 110. Each of the periodic symmetric cells 110 comprises first projections 130 and second projections 140 along the Y axis. A set of first projections 130 extend from a first wall 135 and a set of second projections 140 extend from a second wall 145. With reference now to FIG. 1C, one embodiment of a cell 110 of the waveguide 100 is shown along axes X, Y, and Z. Each periodic cell 110 comprises a set of first projections 130*a*, 130*b* extending from the first wall 135 and a second projection 140 extending from the second wall 145. The second projection 140 is located symmetrically between the pair of first projections 130*a*, 130*b*. The first projections 130*a*, 130*b* and the second projections 140 may comprise, for example, a metal material, a dielectric material, or a combination of metal and dielectric materials, which may be referred to as a composite stack. The first projections 130*a*, 130*b* and the second projections 140 may also comprise one or more dielectric rods metallically sputtered asymmetrically on an interior surface of the waveguide 100. U.S. Pat. No. 8,179,045, entitled "Slow Wave Structure Having Offset Projections Comprised of a Metal-Dielectric Composite Stack," issued on May 15, 2012, is hereby incorporated by reference in its entirety.

The symmetric waveguide 100 (FIG. 1B) may comprise multiple modes, such as a first, or fundamental, mode and a second mode. Each mode may comprise one or more forward-wave segments and one or more backward-wave segments. During a forward-wave segment, an input RF wave travels along the axis of propagation in the direction shown by arrow 120 (FIG. 1B) and is complimentary to the electron beam 102 (FIG. 1B). During a backward-wave segment, a reflected RF wave is traveling in the opposite direction of arrow 120. In a symmetrical waveguide structure, such as waveguide 100, the backward-wave segment of higher modes, for example, the backward-wave segment of the second mode, may intersect the electron beam 102. The second made may be referred to as a backward-wave mode due to the interaction between the second mode's backward-wave segment and the electron beam 102. The interaction between a backward wave and the electron beam 102 causes backward-wave oscillation in the symmetrical waveguide 100. The backward-wave oscillation effectively limits the usable amplification and the usable bandwidth of the waveguide 100.

Figure 2A:
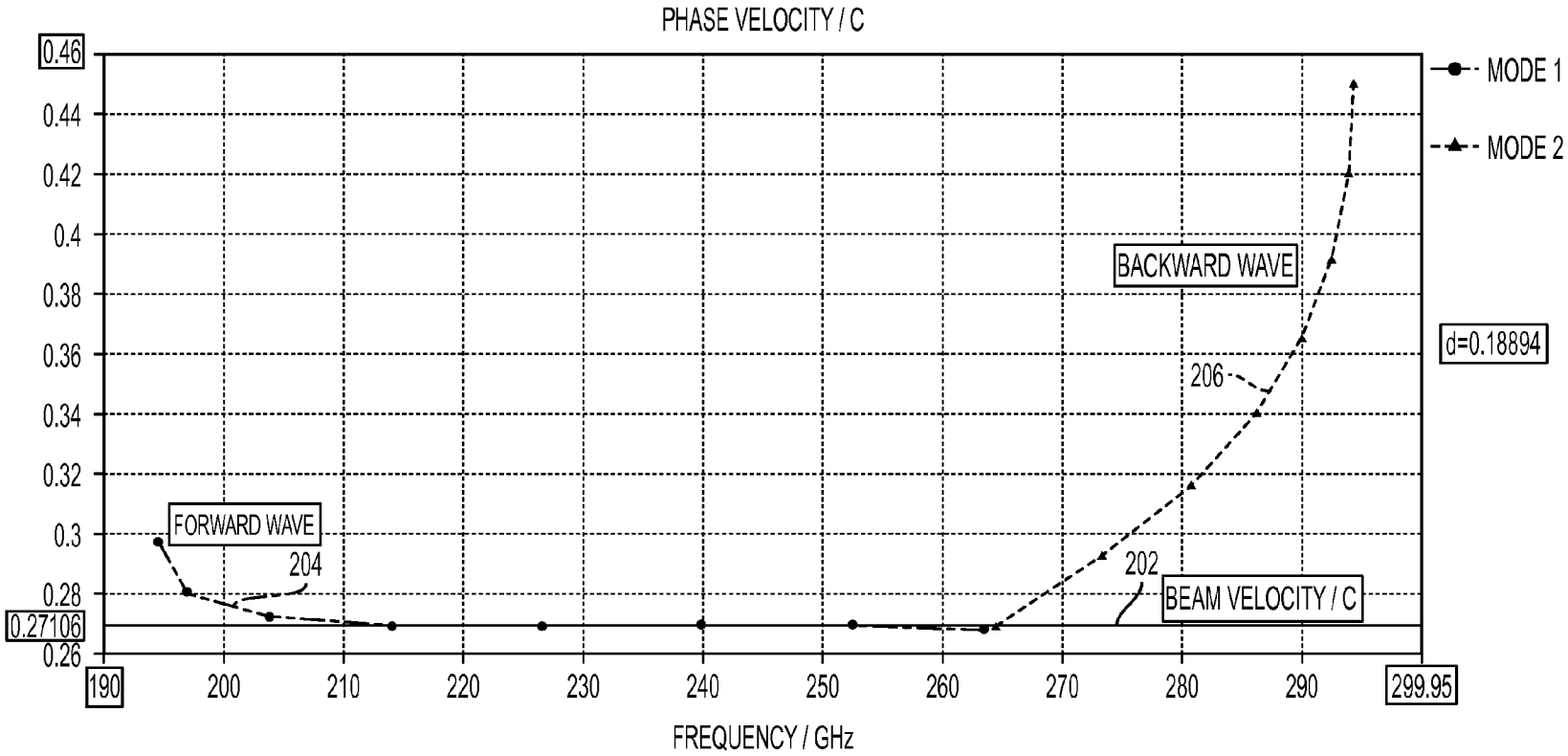
FIGS. 2A-2B illustrate the interaction between an input radiofrequency wave and an input electron beam in the symmetric waveguide structure of FIGS. 1A-1C.
Figure 2B:
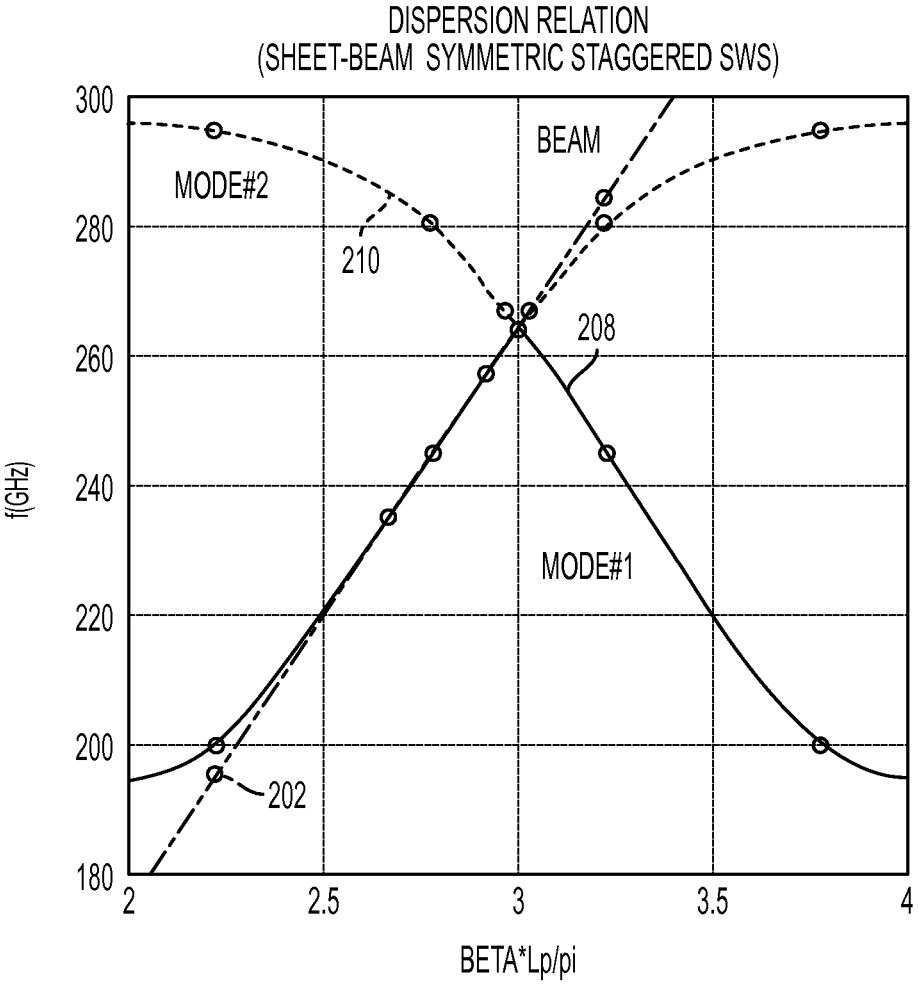

FIG. 2A illustrates a phase velocity relationship of phase velocity versus frequency of a forward wave 204 ("MODE 1") and a backward wave 206 ("MODE 2") of the symmetrical waveguide 100 interacting with an electron beam 202 traveling with a beam velocity relative to the speed of light (C) where the distance between symmetric cells is "d," which d is 0.18894. The horizontal axis displays a Frequency range between 190 and 299.95 GHz and the vertical axis displays a Phase Velocity range relative to the speed of light between 0.26 and 0.46. The forward wave 204 and the backward wave 206 may intersect. For example, in the illustrated embodiment, the forward wave 204 and the backward wave 206 intersect at a frequency of 265 GHz. The intersection point may be referred to as the pi point. The pi point may correspond to the frequency at which the backward wave 206 begins to develop. Near the intersection point, both the forward wave 204 and the backward wave 206 interact with the electron beam 202 having a phase velocity relative to the speed of light of 0.27106. The interaction between the electron beam 202 and the backward wave 206 causes the backward wave 206 to be amplified and creates backward-wave oscillation in the waveguide 100. The backward-wave oscillation effectively limits the bandwidth of the waveguide 100. FIG. 2B illustrates a dispersion relation between the electron beam ("BEAM") 202, a first mode 204 ("MODEM"), and a second mode 206 ("MODE#2") in the waveguide 100. The horizontal axis represents BETA*Lp/pi, where BETA ($\beta$) is the circuit wave number, $L_p$ is the period length of the slow wave structure, and pi is $\pi$. The vertical axis represents frequency ("f") (GHz). As can be seen in FIG. 2B, the first mode 208 and the second mode 210 overlap, for example, at the pi point of 265 GHz. To the left of the pi point, the first mode 208 is still in a forward-wave segment. The first mode's 208 backward-wave segment, which develops when the circuit wave number times the length of the cell divided by pi is greater than three, does not interact with the electron beam 202. However, to the left of the pi point, the second mode's 210 backward-wave segment has already developed and interacts with the electron beam 202. Due to the interaction between the electron beam 202 and the backward-wave segment of the second mode 210, the waveguide will experience backward-wave oscillation. The backward-wave oscillation limits the input bandwidth of the waveguide 100 (FIG. 1B). The symmetric waveguide 100 (FIG. 1B) has a theoretical bandwidth of about 23%. However, the backward-wave oscillation causes the bandwidth of the symmetric waveguide 100 (FIG. 1B) to be reduced from a theoretical bandwidth of about 23% to a practical bandwidth of about 3%.

Figure 3A:
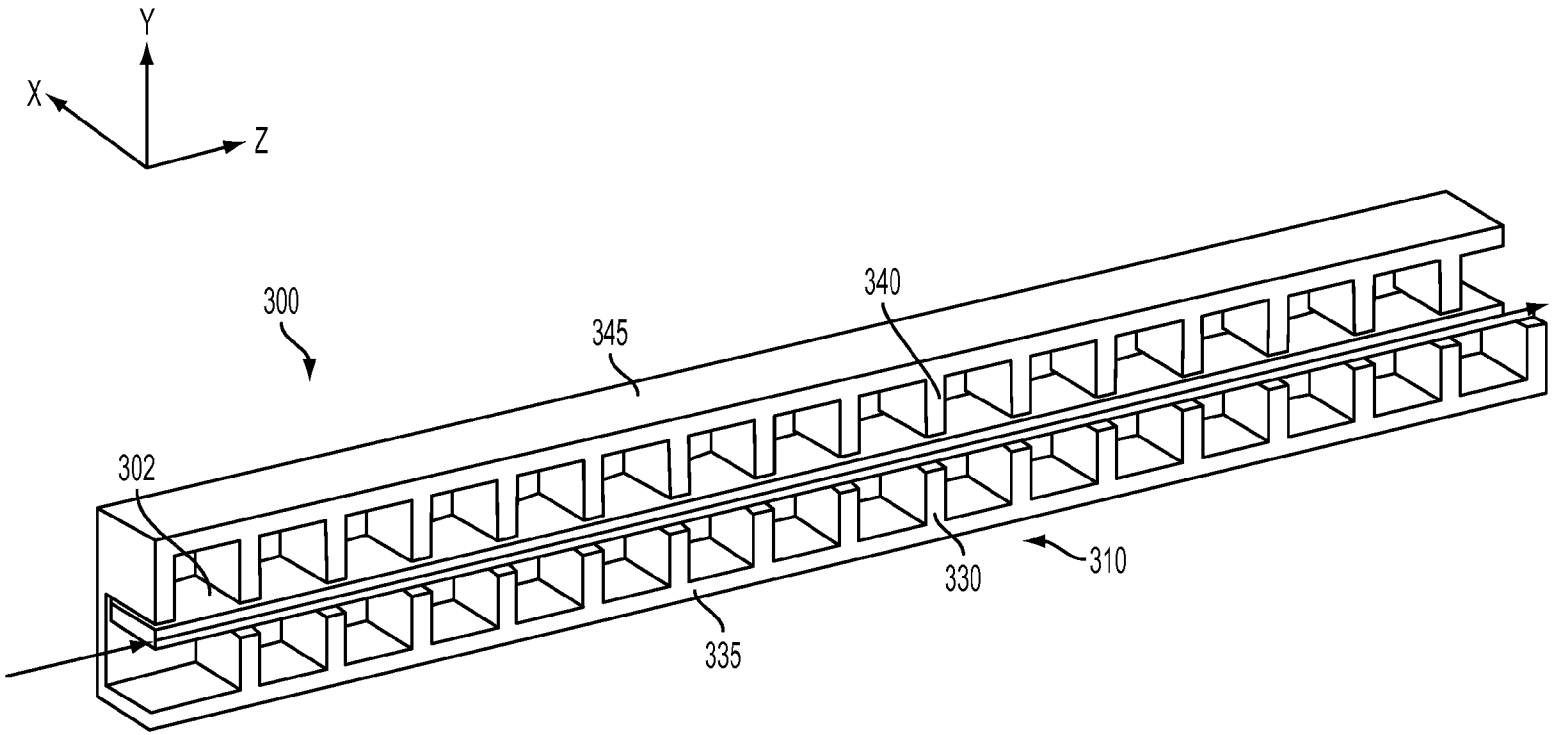
FIG. 3A illustrates one embodiment of an asymmetric slow wave structure.
Figure 3B:
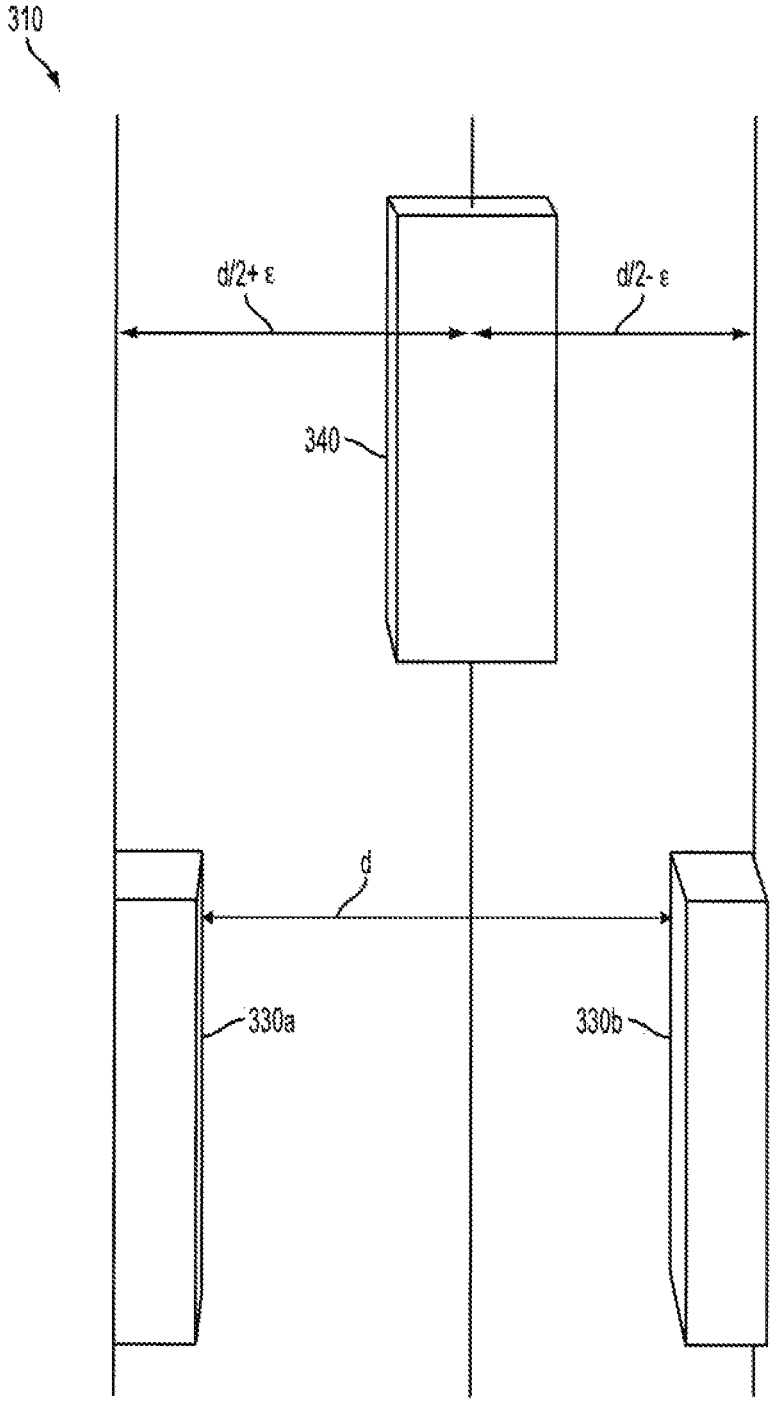
FIG. 3B illustrates one embodiment of an asymmetric cell.

FIG. 3A illustrates an asymmetric slow wave structure. The asymmetric waveguide 300 comprises a plurality of asymmetric cells 310. FIG. 3B illustrates one embodiment of an asymmetrical cell 310 of the asymmetric waveguide 300. The asymmetric cell 310 may comprise a pair of first projections 330*a*, 330*b* extending from a first wall 335 and a second projection 340 extending from a second wall 345. The first projections 330*a*, 330*b* may be separated by a distance d. The second projection 340 may be located asymmetrically between the pair of first projections 330*a*, 330*b*. For example, in the illustrated embodiment, the center point of the second projection 340 is located at a distance of d/2+∈ from the first of the pair of first projections 330*a* and at a distance of d/2−∈ from the second of the pair of first projections 330*b*, wherein ∈ is a non-zero offset of the second projection 340. The asymmetric waveguide 300 may be generated by arranging a plurality of asymmetric cells 310 periodically. The asymmetric waveguide 300 may be configured to receive an input electron beam 302 and an input RF wave. The input RF wave may comprise a pure transverse-magnetic (TM) field or a combination of a transverse-magnetic (TM) field and a transverse-electric (TE) field.

FIG. 3A illustrates an asymmetric slow wave structure. The asymmetric waveguide 300 shown along axes X, Y, and Z comprises a plurality of asymmetric cells 310. FIG. 3B illustrates one embodiment of an asymmetrical cell 310 of the asymmetric waveguide 300. The asymmetric cell 310 may comprise a pair of first projections 330*a*, 330*b* extending from a first wall 335 (FIG. 3A) and a second projection 340 extending from a second wall 345 (FIG. 3A). The first projections 330*a*, 330*b* may be separated by a distance d. The second projection 340 may be located asymmetrically between the pair of first projections 330*a*, 330*b*. For example, in the illustrated embodiment, the center point of the second projection 340 is located at a distance of d/2+∈ from the first of the pair of first projections 330*a* and at a distance of d/2−∈ from the second of the pair of first projections 330*b*, wherein ∈ is a non-zero offset of, the second projection 340. The asymmetric waveguide 300 may be generated by arranging a plurality of asymmetric cells 310 periodically. The asymmetric waveguide 300 may be configured to receive an input electron beam 302 (FIG. 3A) and an input RF wave. The input RF wave may comprise a pure transverse-magnetic (TM) field or a combination of a transverse-magnetic (TM) field and a transverse-electric (TE) field.

Figure 4A:
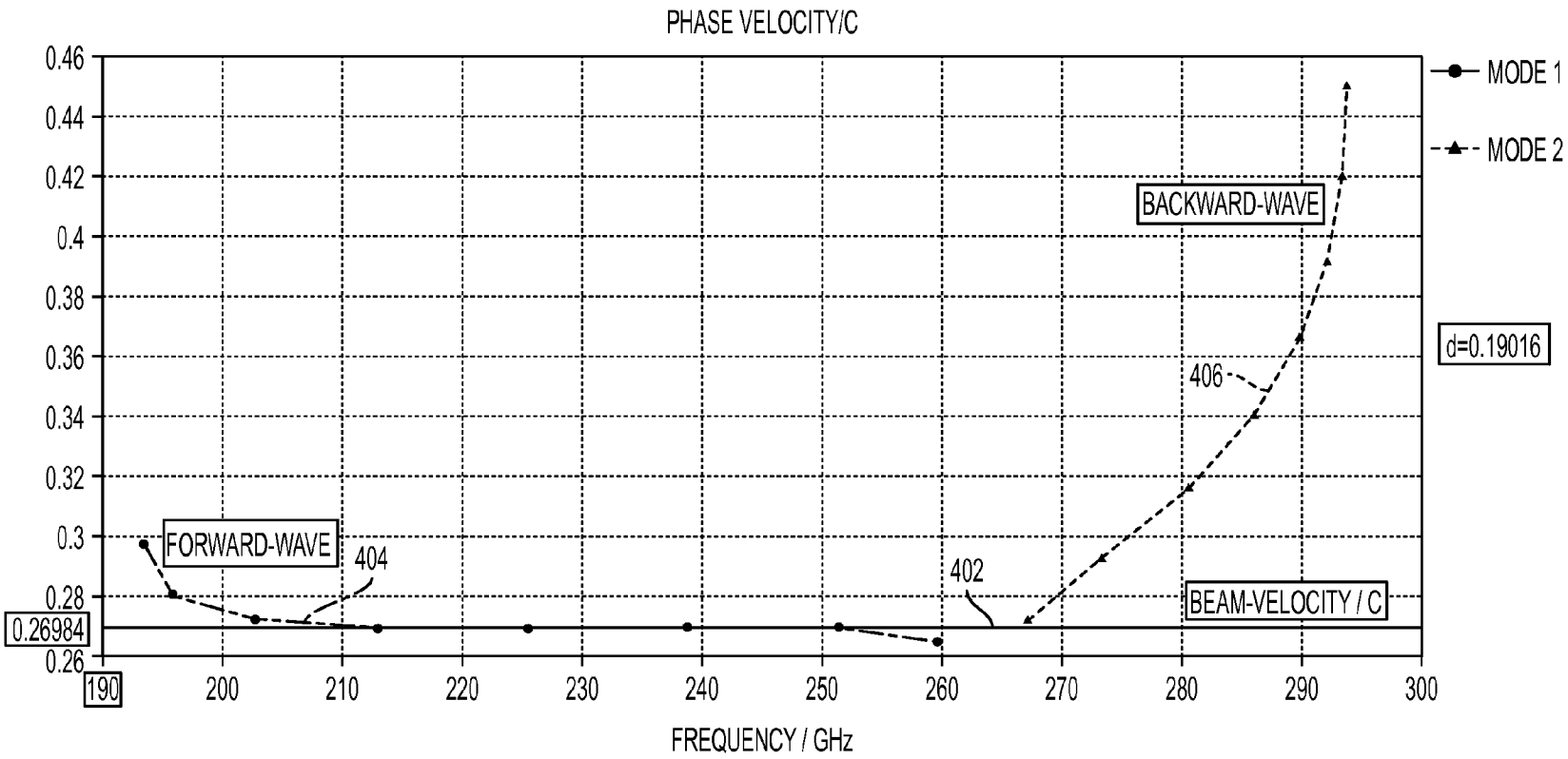
FIGS. 4A-4B illustrate an interaction between an input radiofrequency wave and an input electron beam in the asymmetric slow wave structure of FIG. 3A.

FIG. 4A illustrates a phase velocity relationship of phase velocity versus frequency of a forward wave 404 ("MODE 1") and a backward wave 406 ("MODE 2") of an asymmetric waveguide 300 interacting with an electron beam 402 traveling with a beam velocity relative to the speed of light (C) where the distance between asymmetric cells is "d," in which d is 0.19016. The horizontal axis displays a Frequency range between 190 and 300 GHz and the vertical axis displays a Phase Velocity range relative to the speed of light between 0.26 and 0.46. As can be seen in FIG. 4A the forward wave 404 intersects the electron beam 402, having a phase velocity relative to the speed of light of 0.26984, for almost the entire bandwidth of the forward wave. The plurality of asymmetric cells 310 (FIG. 3A) creates a band-gap between the forward wave 404 and the backward wave 406 of the asymmetric waveguide 300 (FIG. 3A) at the pi point. The backward wave 406 of the asymmetric waveguide 300 (FIG. 3A) lacks a phase velocity component that intersects with the electron beam 402. Therefore, the backward wave 406 is not amplified by the electron beam 402 and backward-wave oscillation does not occur in the asymmetric waveguide 300.

Figure 4B:
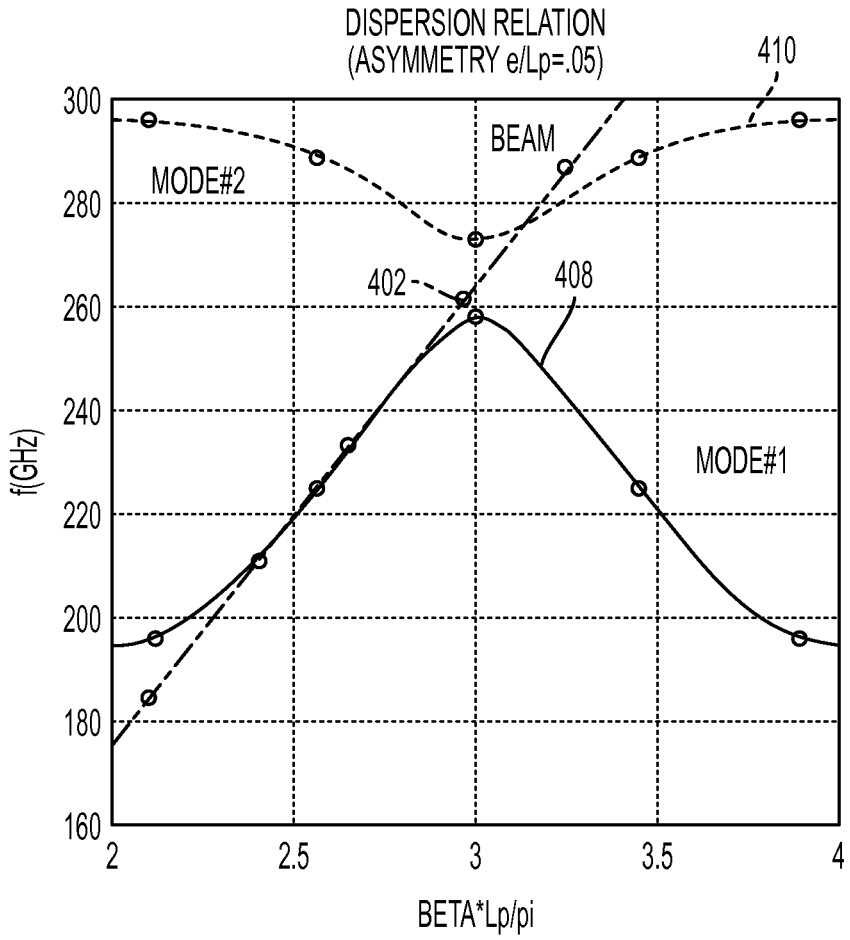

FIG. 4B illustrates a dispersion relation between the first mode 408 ("MODE#1") and the second mode 410 ("MODE#2") of the asymmetric waveguide 300 (FIG. 3A). The horizontal axis represents BETA*Lp/pi, where BETA (β) is the circuit wave number, $L_p$ is the period length of the slow wave structure, and pi is π. The vertical axis represents frequency ("f") (GHz). As can be seen in FIG. 4B, the first mode 408 of the asymmetric waveguide 300 (FIG. 3A) is substantially similar to the first mode 208 of the symmetrical waveguide 100 (FIG. 1B). The forward-wave segment of the first mode 408 interacts with the electron beam 402 ("BEAM") over substantially the whole bandwidth of the forward-wave segment. The backward-wave segment of the first mode 408 does not interact with the electron beam 402. In some embodiments, the asymmetric waveguide 300 (FIG. 3A) may comprise a band-gap between the first mode 408 and the second mode 410. The band-gap may be generated by RF reflection in a plurality of asymmetric cells 310 (FIG. 3A). The band-gap may be generated at the pi point between the first mode 408 and the second mode 410. Unlike in the symmetrical waveguide 100 (FIG. 1B), the backward-wave segment of the second mode 410 does not interact with the electron beam 402. Due to the band-gap, the only interaction between the second mode 410 and the electron beam 402 occurs in the forward-wave segment of the second mode 410. There is no interaction between a backward wave and the electron beam 402, and therefore amplification of a backward wave does not occur. By eliminating amplification of the backward wave, the asymmetric waveguide 300 (FIG. 3A) does not experience backward wave-oscillation. The asymmetric waveguide 300 (FIG. 3A) may have a theoretical bandwidth substantially equally to the theoretical bandwidth of the symmetric waveguide 100 (FIG. 1B), about 23%. The asymmetric waveguide 300 (FIG. 3A) may maintain the same first mode impedance as the symmetric waveguide 100 (FIG. 1B). However, because the asymmetric waveguide 300 (FIG. 3A) generates a band-gap of forbidden propagation frequencies, the backward-wave segment of the second mode 410 does not have a phase velocity component synchronous with the electron beam 402 and therefore is not amplified by the electron beam 402. Because the backward-wave segment of the second mode 410 does not interact with the electron beam 402, backward-wave oscillation does not occur in the asymmetric waveguide 300 (FIG. 3A) and the asymmetric waveguide 300 (FIG. 3A) may function substantially at the theoretical bandwidth, about 23%.

In some embodiments, an asymmetric slow wave structure, such as, for example, the asymmetric waveguide 300, may comprise a plurality of asymmetric cells comprising two asymmetric substructures comprising different phase velocities $V_{p1}$ and $V_{p2}$, such as, for example, a plurality of asymmetrical cells 310. The asymmetric cells may receive an input RF wave, such as, for example, a transverse-magnetic field input RF wave. The radial frequency to circuit wave number curve (ω-β) of the slow wave structure may be given by the equation:

$$\cos(\beta * L_p) = \cos(\beta_1 * a_1) * \cos(\beta_2 * a_2) - 0.5 * \left[\frac{V_{p1}}{V_{p2}} + \frac{V_{p2}}{V_{p1}}\right] * \sin(\beta_1 * a_1) * \sin(\beta_2 * a_2) \quad (1)$$

wherein $L_p$ is the period length of the slow wave structure, $a_j$ (j=1,2) is the substructure length of the asymmetric structure such that $a_1+a_2=L_p$, β is the circuit wave number, and $V_{pj}$=1, 2) is the phase velocity of the electromagnetic frequency, f, in each sub-cell such that:

$$\beta_j = \frac{\omega}{V_{pj}} (j = 1, 2); \text{ and} \quad (2)$$

$$\omega = 2\pi f \quad (3)$$

A band-gap in the dispersion relation of equation (1) will occur wherever the right-hand side of the equation (1) exceeds 1. The first band-gap will therefore exist at:

$$\beta * L_p = \pi \pm i * x \; i = \sqrt{-1} \quad (4)$$

The maximum band-gap frequency will be achieved at:

$$\beta_1 * a_1 = \beta_2 * a_2 = \frac{\pi}{2} \quad (5)$$

In this case:

$$x = \ln\left(\left|\frac{V_{p2}}{V_{p1}}\right|\right) \quad (6)$$

Where $\omega_0$ is the center frequency of the band-gap, the band-gap frequencies $\Delta\omega_{gap}$ may be expressed as the equation:

$$\Delta\omega_{gap} = \omega_0 * 4 * \sin^{-1}\left(\frac{|V_{p2} - V_{p1}|}{V_{p1} + V_{p2}}\right) \Big/ \pi \quad (7)$$

which for small variations in phase velocities, $\Delta V_p$, the frequency gap can be approximated by:

$$\Delta\omega_{gap} = \omega_0 * \frac{2}{\pi} * \frac{\Delta V_p}{V_p} \quad (8)$$

As can be seen in equation (8), even a small asymmetry in the individual cells of the slow wave structure creating two sub-cells with different phase velocities may generate a band-gap of forbidden frequencies for the asymmetric slow wave structure. The first order of the forbidden frequency gap is linear with the difference between the two phase velocities. Although the band-gap has been discussed with reference to the asymmetric waveguide 300, a transverse-magnetic field RF wave input and a two-substructure asymmetric cell, those skilled in the art will recognize that a band-gap may be similarly created in any slow wave structure comprising a periodic plurality of asymmetric cells. The asymmetric cells may comprise two or more asymmetric substructures. The asymmetric slow wave structure may be configured to receive a transverse magnetic field and/or a combination transverse magnetic field and transverse-electric field RF wave inputs. For example, a band-gap may be created in asymmetric slow wave structures configured to receive an input electron beam, such as, for example, an electron beam.

In some embodiments, the use of an asymmetric slow wave structure, such as the asymmetric waveguide 300, for example, may allow the size of the slow wave structure to be reduced as compared to a symmetric slow wave structure, such as the symmetric waveguide 100, configured for use in comparable frequency ranges. In symmetric slow wave structures it may be necessary to add attenuation sections to the slow wave structure to cause attenuation of the backward wave in an attempt to limit backward-wave oscillation. However, the attenuation sections also affect forward wave amplification, and therefore additional symmetric cells must be added to compensate for the loss of power in the forward wave. The additional symmetric cells may necessitate additional attenuation sections. The feedback loop created between adding attenuation sections and compensating amplification sections may result in extremely large slow wave structures. In contrast, attenuation sections are not required in asymmetric slow wave structures, as backward wave oscillation does not occur in the asymmetric slow wave structures. Therefore, a smaller asymmetric slow wave structure may provide equivalent, or better, amplification than a larger symmetrical slow wave structure comprising multiple attenuation sections.

Figure 5:
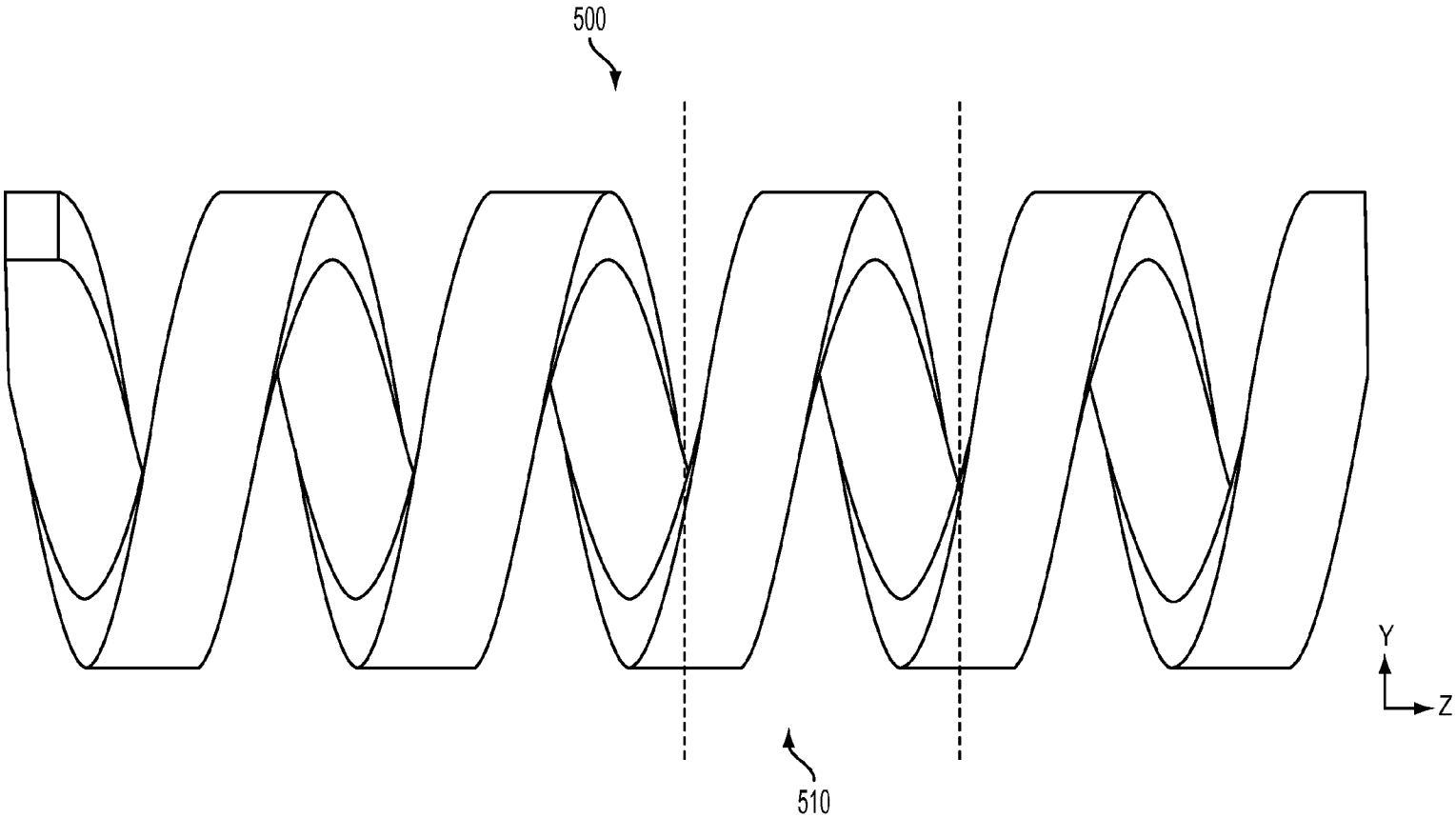
FIG. 5 illustrates one embodiment of a symmetric helical waveguide structure.

FIG. 5 illustrates one embodiment of a symmetrical helical waveguide 500, shown along the Z-Y plane where the X axis is shown into the page and the Z-Y plane is shown on the page, configured to receive an electron beam. The symmetrical helical waveguide 500 comprises a plurality of symmetrical cells 510 arranged periodically along the length of the symmetrical helical waveguide 500. The symmetrical cells 510 are symmetrical along each of a pitch, an azimuth, and a radius. The symmetrical helical waveguide 500 receives an RF input wave and slows the RF input wave to match the electron beam. The symmetrical helical waveguide 500 comprises a forward-wave segment during which the input RF wave and the electron beam are traveling in the same direction along the axis of propagation. The symmetrical helical waveguide 500 comprises a backward-wave segment during which a reflected RF wave is traveling in the opposite direction of the axis of propagation of the electron beam.

Figure 6:
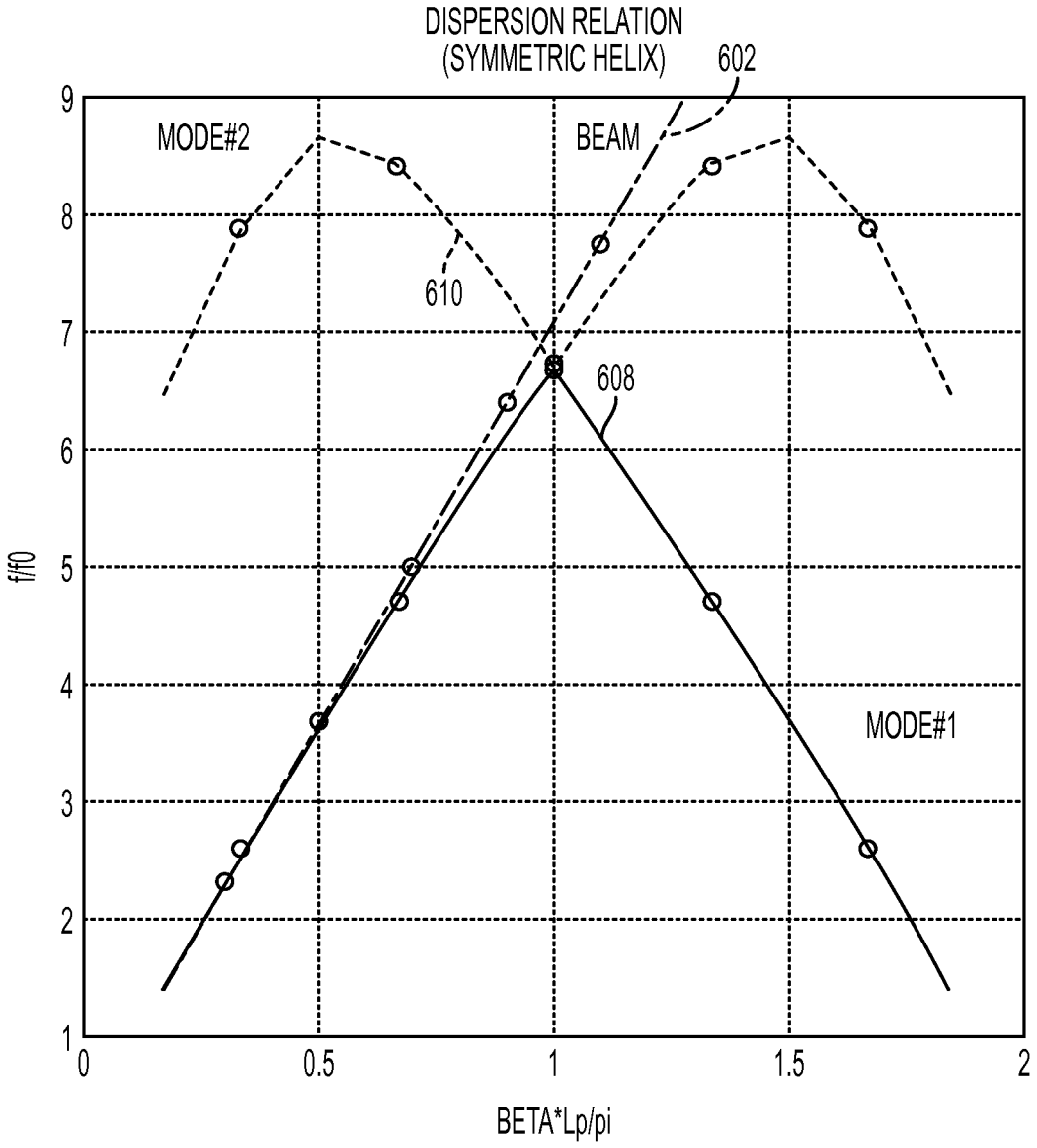
FIG. 6 illustrates one embodiment of a dispersion relation of the symmetric helical waveguide structure of FIG. 5.

FIG. 6 illustrates a dispersion relation of the symmetrical helical waveguide 500. The horizontal axis represents BETA*Lp/pi, where BETA (β) is the circuit wave number, $L_p$ is the period length of the slow wave structure, and pi is π. The vertical axis represents the scaled frequency ("f/f0"). As can be seen in FIG. 6, the forward-wave segment of the first mode 608 ("MODE#1") and the backward-wave segment of the second mode 610 ("MODE#2") both intersect with the electron beam 602. In the symmetrical helical waveguide 500, the backward wave may comprise a phase velocity that intersects with the electron beam 602 and causes amplification of the backward wave. Amplification of the backward wave results in backward-wave oscillation of the symmetrical helical waveguide 500. The backward wave oscillation reduces the bandwidth of the symmetrical helical waveguide 500 similar to the reduction in bandwidth discussed above with respect to symmetrical waveguide 100.

Figure 7:
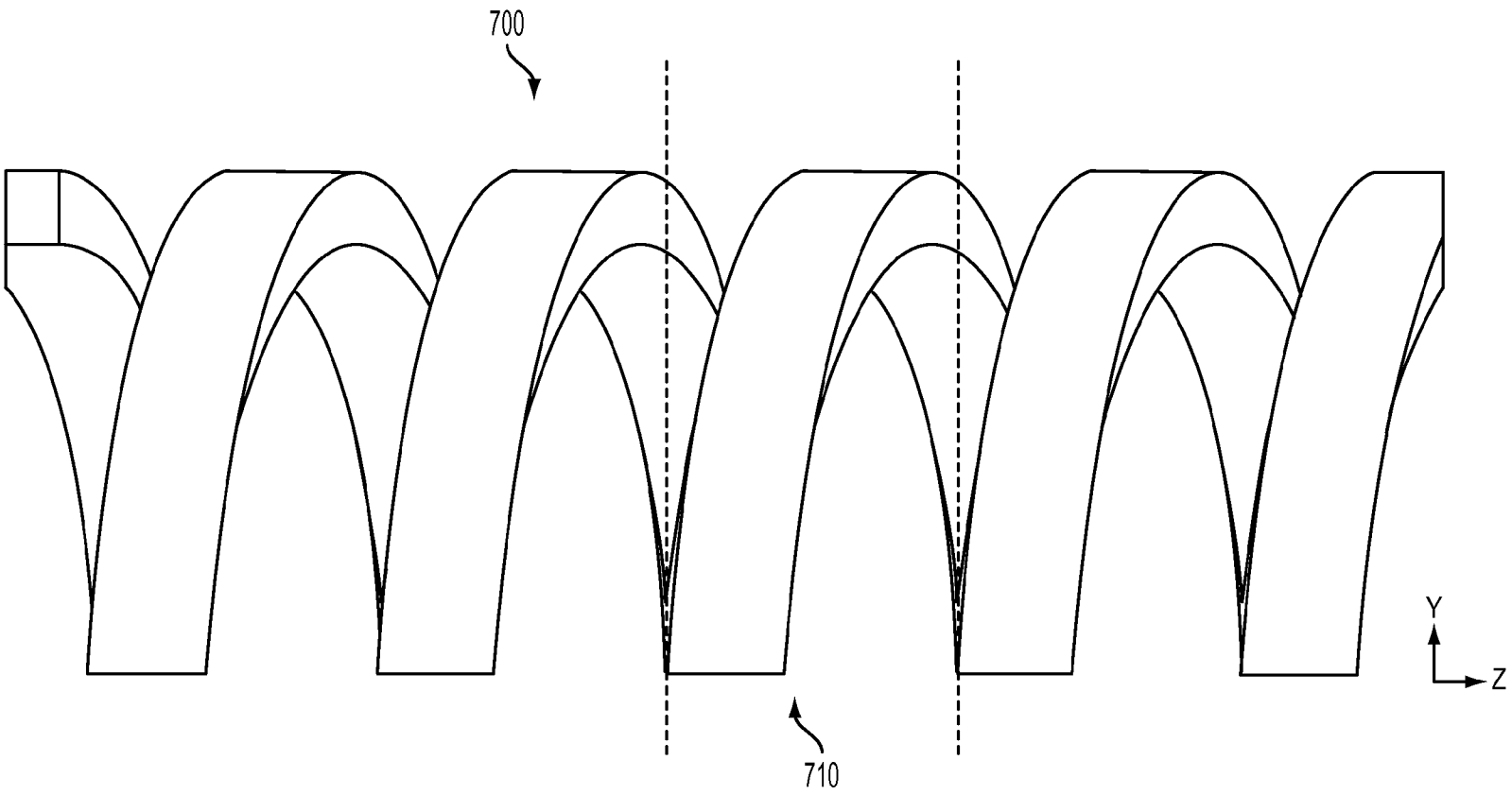
FIG. 7 illustrates one embodiment of an asymmetric helical waveguide structure.

FIG. 7 illustrates one embodiment of an asymmetrical helical waveguide 700 shown along the Z-Y plane where the X axis is shown into the page and the Z-Y plane is shown on the page. The asymmetric helical waveguide 700 comprises a plurality of asymmetrical helical cells 710 disposed periodically along the length of the asymmetrical helical waveguide 700. The asymmetrical cells 710 comprise a pitch, an azimuth, and a radius. At least one of the pitch, the azimuth, and/or the radius may vary within the asymmetric cell 710. For example, in the embodiment illustrated in FIG. 7, the asymmetrical cells 710 comprise a pitch angle that varies over the period of each asymmetric cell 710. In some embodiments, the pitch, the azimuth and/or the radius of the helix may be varied over the length of the asymmetrical cell 710.

Figure 8A:
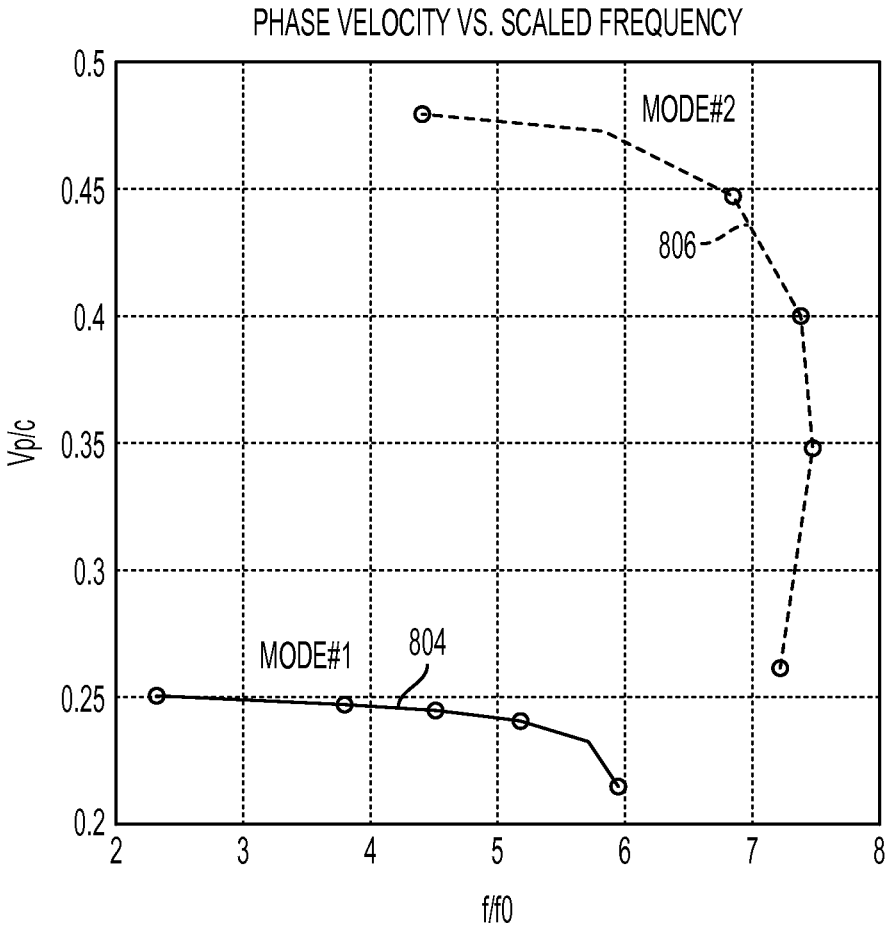
FIG. 8A illustrates one embodiment of a dispersion relation of the asymmetric helical waveguide structure of FIG. 7.

FIG. 8A shows one embodiment of a phase velocity of a forward wave 804 and a backward wave 806 within the asymmetrical helical waveguide 700 (FIG. 7). The horizontal axis represents the scaled frequency ("f/f0") and the vertical axis represents the phase velocity relative to the speed of light ("$V_p$/c"). As can be seen in FIG. 8A, a large band-gap exists between the forward wave 804 ("MODE#1") and the backward wave 806 ("MODE#2"). The forward wave 804 comprises a phase velocity component that coincides with an electron beam 802 received by the asymmetric helical waveguide 700 (FIG. 7). The band-gap between the forward wave 804 and the backward wave 806 prevents the backward wave 806 from interacting with the electron beam 802 and prevents backward-wave oscillation in the asymmetric helical waveguide 700 (FIG. 7).

Figure 8B:
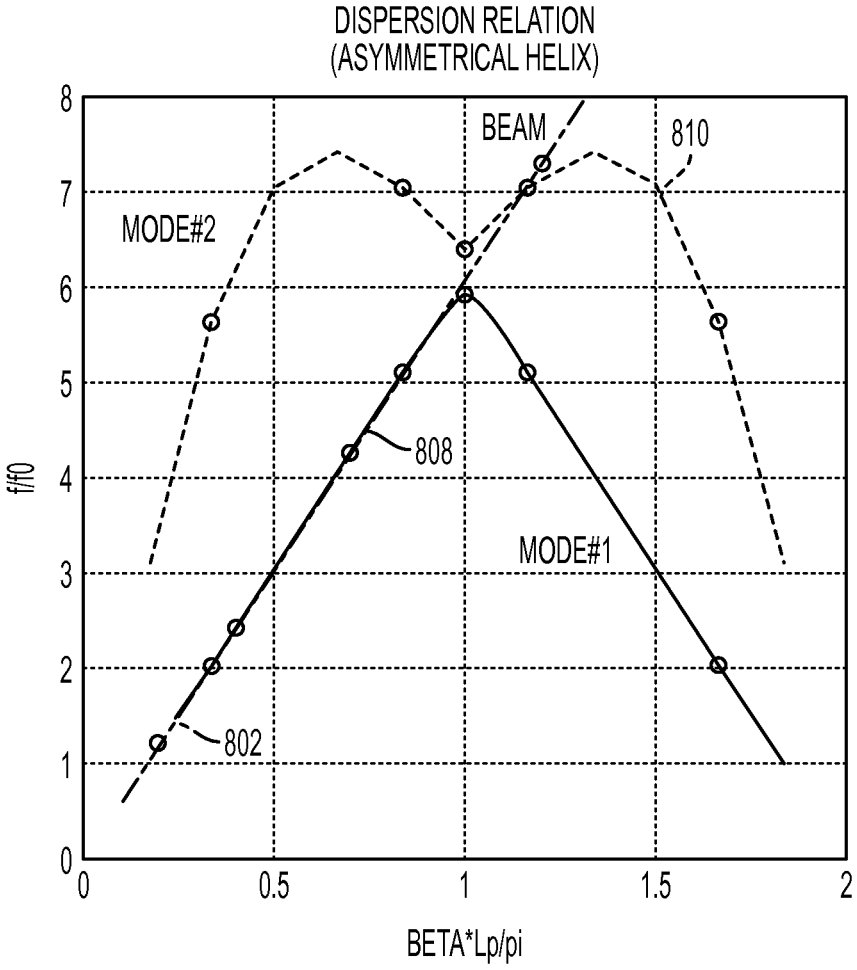
FIG. 8B illustrates one embodiment of phase velocity and frequency relationship of the asymmetric helical waveguide structure of FIG. 7.
Figure 9:
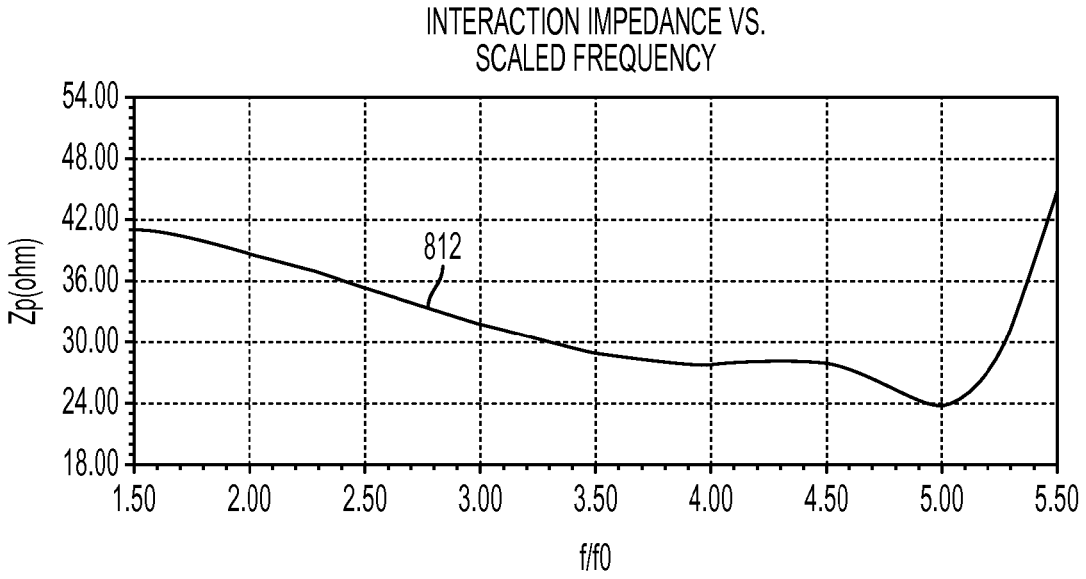
FIG. 9 illustrates the impedance and frequency relationship of the asymmetric helical waveguide structure of FIG. 7.

FIG. 8B shows one embodiment of the dispersion relation of the asymmetrical helical waveguide 700. The horizontal axis represents BETA*$L_p$/pi, where BETA (β) is the circuit wave number, $L_p$ is the period length of the slow wave structure, and pi is π. The vertical axis represents the scaled frequency (f/f0). As can be seen in FIG. 8B, the forward wave segment of the first mode 808 (MODE#1) intersects the electron beam 802 over substantially the entire bandwidth of the forward wave segment. The backward wave segment of the first mode 808 does not intersect the electron beam 802. The asymmetrical helical waveguide 700 comprises a band-gap between the first mode 808 and the second mode 810 (MODE#2). As a result of the band-gap, the backward wave segment of the second mode 810 does not comprise a phase velocity component that interacts with the electron beam 802. The only interaction between the second mode 810 and the electron beam 802 occurs in the forward-wave segment of the second mode 808. By creating a band-gap between the first mode 808 and the second mode 810, the asymmetrical helical waveguide 700 allows a wider bandwidth of the first mode 808 to be used, as backward-wave oscillation does not occur and therefore does not limit the bandwidth of the first mode 808. As with the asymmetric waveguide 300 discussed above with respect to FIGS. 3A, 3B, 4A and 4B, the asymmetrical helical waveguide 700 has the same theoretical bandwidth as the symmetrical helical waveguide 500. However, because the asymmetrical helical waveguide 700 does not produce backward-wave oscillation, the asymmetrical helical waveguide 700 is able to use a larger portion of the theoretical bandwidth of the slow wave structure. In contrast, the symmetrical helical waveguide 500 is limited to a fraction of the theoretical bandwidth. In some embodiments, the asymmetric helical waveguide 700 may have a useable bandwidth of about three times the useable bandwidth of the symmetric helical waveguide 500, for example. FIG. 9 illustrates one embodiment of an impedance response 812 of the asymmetric helical waveguide 700. The horizontal axis represents the scaled frequency ("f/f0") and the vertical axis represents impedance ("$Z_p$") in ohms. The impedance (Zp in ohms) is plotted versus the scaled frequency (f/f0) of the input RF wave. The impedance response 812 of the first mode of the asymmetrical helical waveguide 700 is substantially similar to the impedance response of the first mode of the symmetrical helical waveguide 500 accept at the pi point.

In some embodiments, the input electron beam, for example the electron beam 802, may comprise, for example, an elliptical electron beam, a circular electron beam, and/or a hollow electron beam. The electron beam may comprise a plurality of electron beams. The plurality of electron beams may be generated by a plurality of electron guns. The plurality of electron beams may comprise a plurality of elliptical electron beams, circular electron beams, hollow electron beams, sheet electron beams, or any combination thereof.

In one embodiment, the asymmetrical helical waveguide 700 may comprise a discontinuous helical structure. For example, the asymmetrical helical waveguide 700 may comprise a periodic plurality of cells comprising a first pitch at a first angle and a second pitch at a second angle. The first and second pitches may be discontinuous. A discontinuous helix may be generated by any suitable manufacturing technique, such as, for example, electro-discharge machining (EMD). The discontinuous pitches may modify the dispersion relation of the discontinuous helical waveguide.

Figure 10:
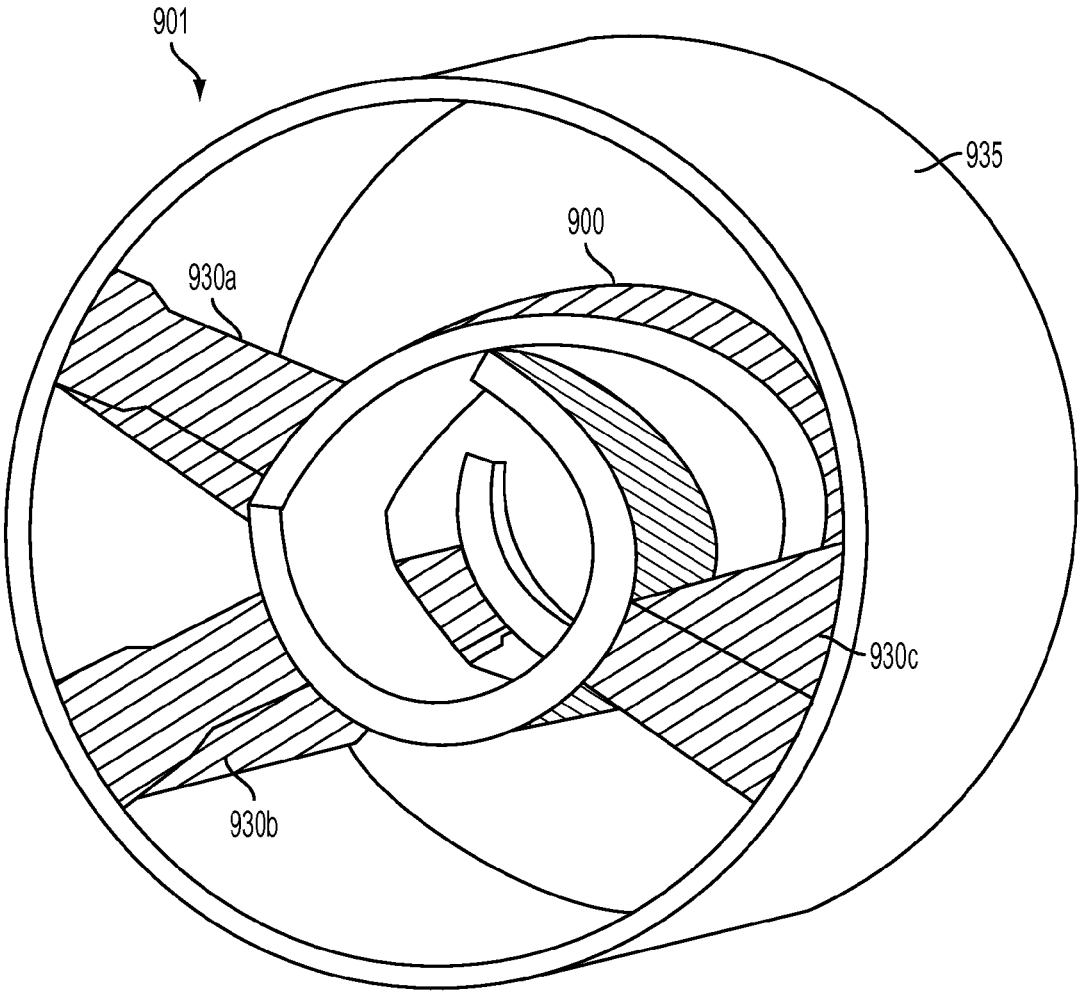
FIG. 10 illustrates one embodiment of an asymmetric helical waveguide structure comprising a plurality of vanes.

FIG. 10 illustrates one embodiment of an asymmetrical slow-wave-structure 901. The asymmetrical slow-wave-structure 901 comprises a helical waveguide 900 and a plurality of vanes 930*a*, 930*b*, 930*c*. The plurality of vanes may extend from a housing 935 circumferentially located with respect to the helical waveguide 900. The plurality of vanes 930 may comprise a composite stack of a dielectric material and a metal material, for example. In various embodiments, the helical waveguide 900 and/or the plurality of vanes 930*a*, 930*b*, 930*c* may be asymmetric. The plurality of vanes 930 may comprise a composite stack of a dielectric material and a metal material, for example. For example, the helical waveguide 900 may be an asymmetric helical waveguide comprising a plurality of asymmetric cells, such as, for example, the asymmetric helical waveguide 700 shown in FIG. 7. As another example, the plurality of vanes 930*a*, 930*b*, 930*c* may be asymmetrically arranged about the circumference of the housing 935, such that the distance between the first vane 930*a* and the second vane 930*b* and the distance between the first vane 930*a* and the third vane 930*c* are not equal. In some embodiments, the asymmetric slow-wave-structure 901 may comprise an asymmetric helical waveguide 900 and an asymmetrical plurality of vanes 930*a*-930*c*.

Figure 11:
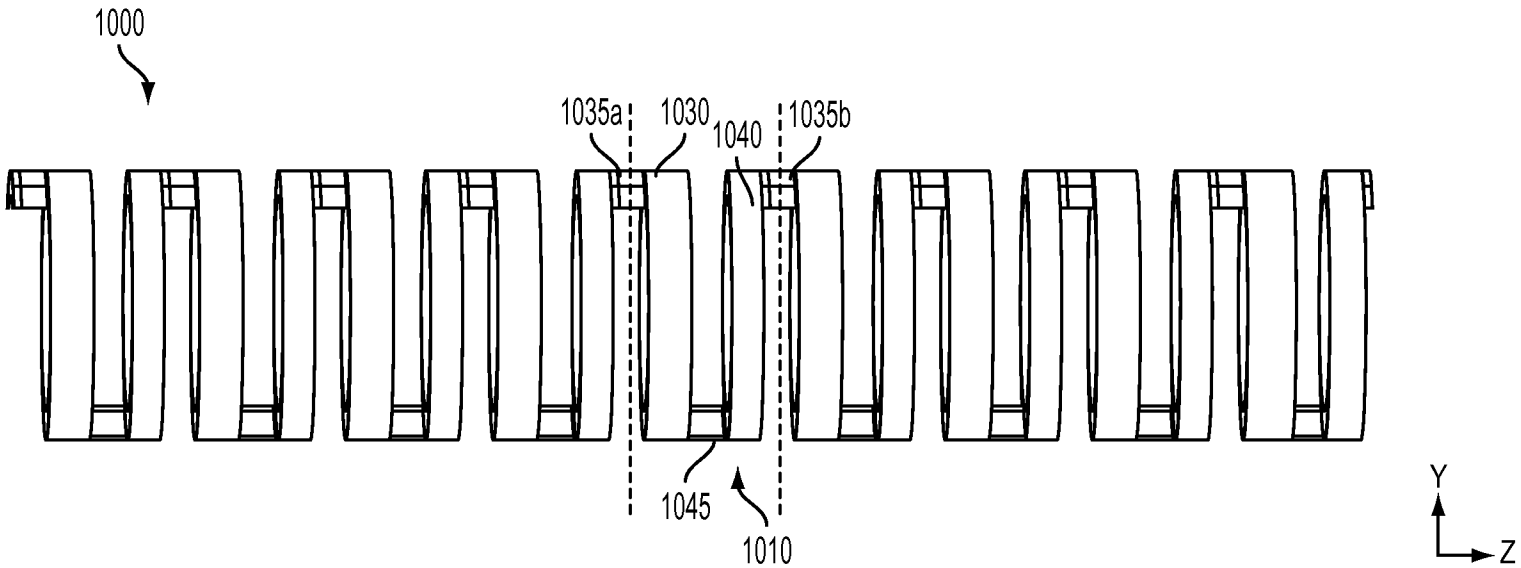
FIG. 11 illustrates one embodiment of an asymmetrical ring-bar waveguide structure.

FIG. 11 illustrates one embodiment of an asymmetric ring-bar waveguide 1000 shown along the Z-Y plane where the X axis is shown into the page and the Z-Y plane is shown on the page. The asymmetric ring-bar waveguide 1000 is configured to receive an input electron beam and an input RF wave. The asymmetric ring-bar waveguide 1000 is configured to generate an interaction between the electron beam and the input RF wave to amplify the input RF wave. The asymmetric ring-bar waveguide 1000 may comprise a periodic plurality of asymmetric cells 1010. The asymmetric cells 1010 may comprise a first ring 1030, a second ring 1040, a first bar 1035*a*, a second bar 1045, and a third bar 1035*b*. The asymmetric cells 1010 may comprise one or more asymmetric structures, such as, for example, asymmetric widths of the first ring 1030 and the second ring 1040, asymmetric radii of the first ring 1030 and the second ring 1040, or asymmetric lengths of the first bar 1035*a*, the second bar 1045, and/or the third bar 1035*b*. For example, in the illustrated embodiment, the first ring 1030 comprises a first width and the second ring 1040 comprises a second width thinner than the first width.

Figure 12:
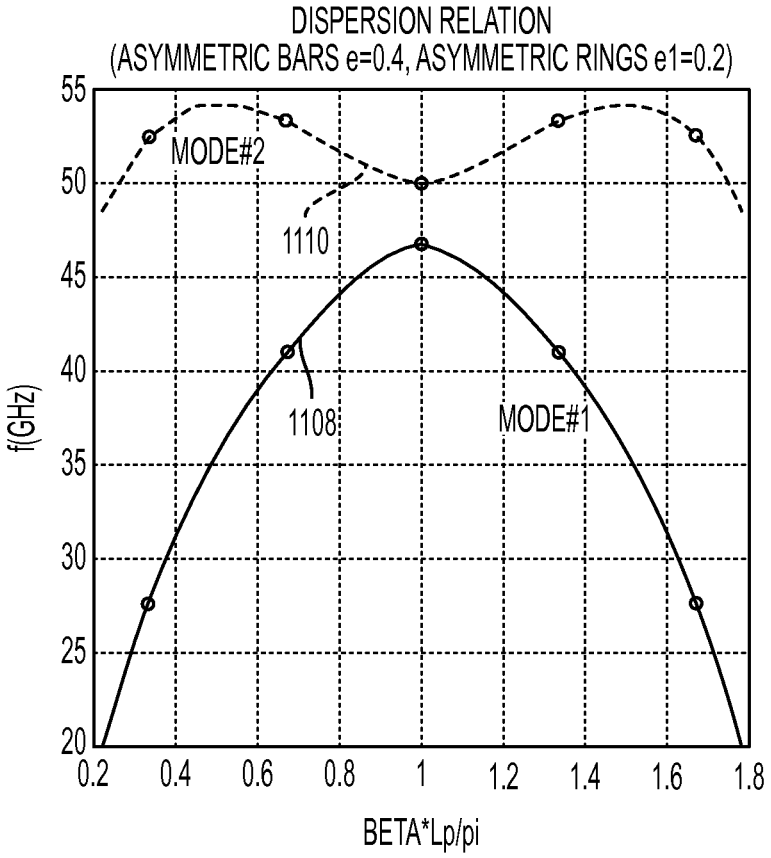
FIG. 12 illustrates one embodiment of a dispersion relation of the asymmetrical ring-bar waveguide structure of FIG. 11

FIG. 12 illustrates the dispersion relation of the asymmetric ring-bar waveguide 1000 shown in FIG. 11. The horizontal axis represents BETA*Lp/pi, where BETA (β) is the circuit wave number, $L_p$ is the period length of the slow wave structure, and pi is π. The vertical axis represents frequency ("f")

in gigahertz ("GHz"). The forward-wave segment of the first mode 1108 ("MODE#1") interacts with the electron beam input into the asymmetric ring-bar waveguide 1000 (FIG. 11). The backward-wave segment of the first mode 1108 does not interact with the electron beam. The asymmetry of each cell 1010 in the asymmetric ring-bar waveguide 1000 (FIG. 11) generates a band-gap at the pi point between the first mode 1108 and the second mode 1110 ("MODE#2") of the asymmetric ring-bar waveguide 1000 (FIG. 11). The band gap prevents interaction between the backward-wave segment of the second mode 1110 and the electron beam as the backward-wave segment lacks a phase velocity component synchronous with the electron beam phase velocity. Because the band-gap eliminates interaction between the backward-wave segment of the second mode 1110 and the electron beam, the asymmetric ring-bar waveguide 1000 (FIG. 11) does not produce backward-wave oscillation.

Figure 13:
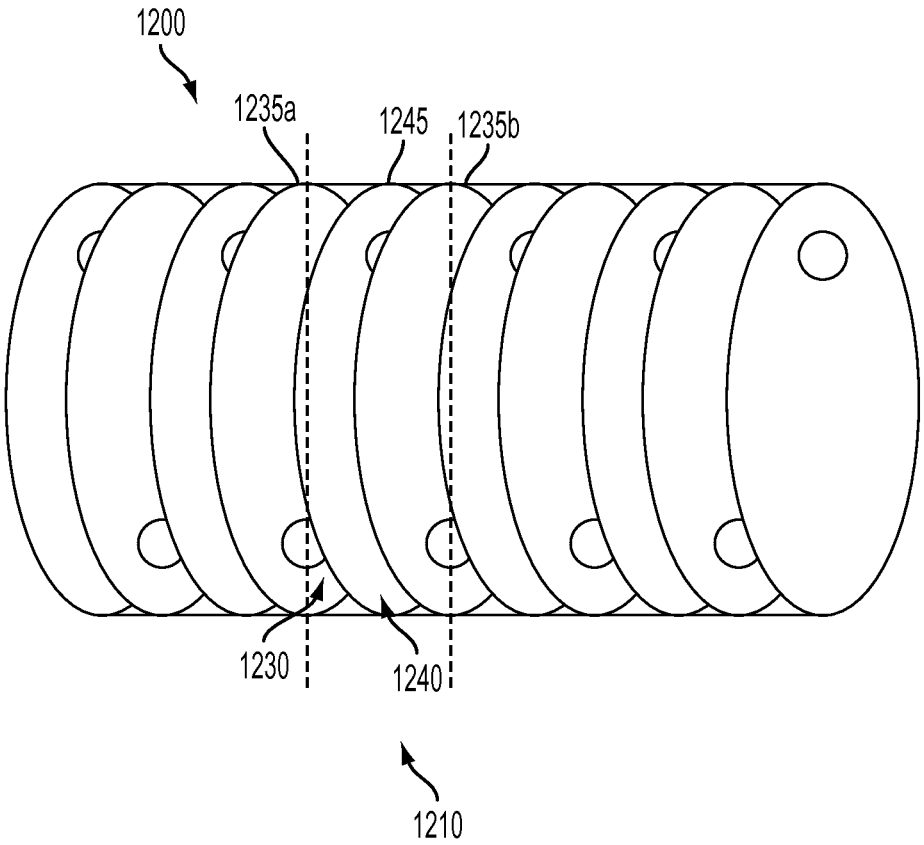
FIG. 13 illustrates one embodiment of an asymmetrical coupled-cavity waveguide structure.

FIG. 13 illustrates on embodiment of an asymmetric coupled-cavity waveguide 1200 configured to receive an input electron beam and an input RF wave. The asymmetric coupled-cavity waveguide 1200 comprises a plurality of asymmetrical cells 1210. The asymmetric cells 1210 comprise end walls 1235*a*, 1235*b* and a middle wall 1245. The end walls 1235*a*, 1235*b* and the middle wall 1245 define one or more resonant cavities 1230, 1240 therebetween. The distance between the first end wall 1235*a* and the middle wall 1245 and the distance between the middle wall 1245 and second end wall 1235*b* may selected such that the one or more resonant cavities 1230, 1240 are asymmetric. The asymmetric resonant cavities 1230, 1240 generate a band-gap between the first mode and the second mod of the asymmetric coupled-cavity waveguide 1200. The band-gap prevents interaction between the backward-wave segment of the second mode and the input electron beam. Because the backward-wave segment and the electron beam do not interact, the asymmetric coupled-cavity waveguide 1200 does not experience backward-wave oscillation.

Figure 14A:
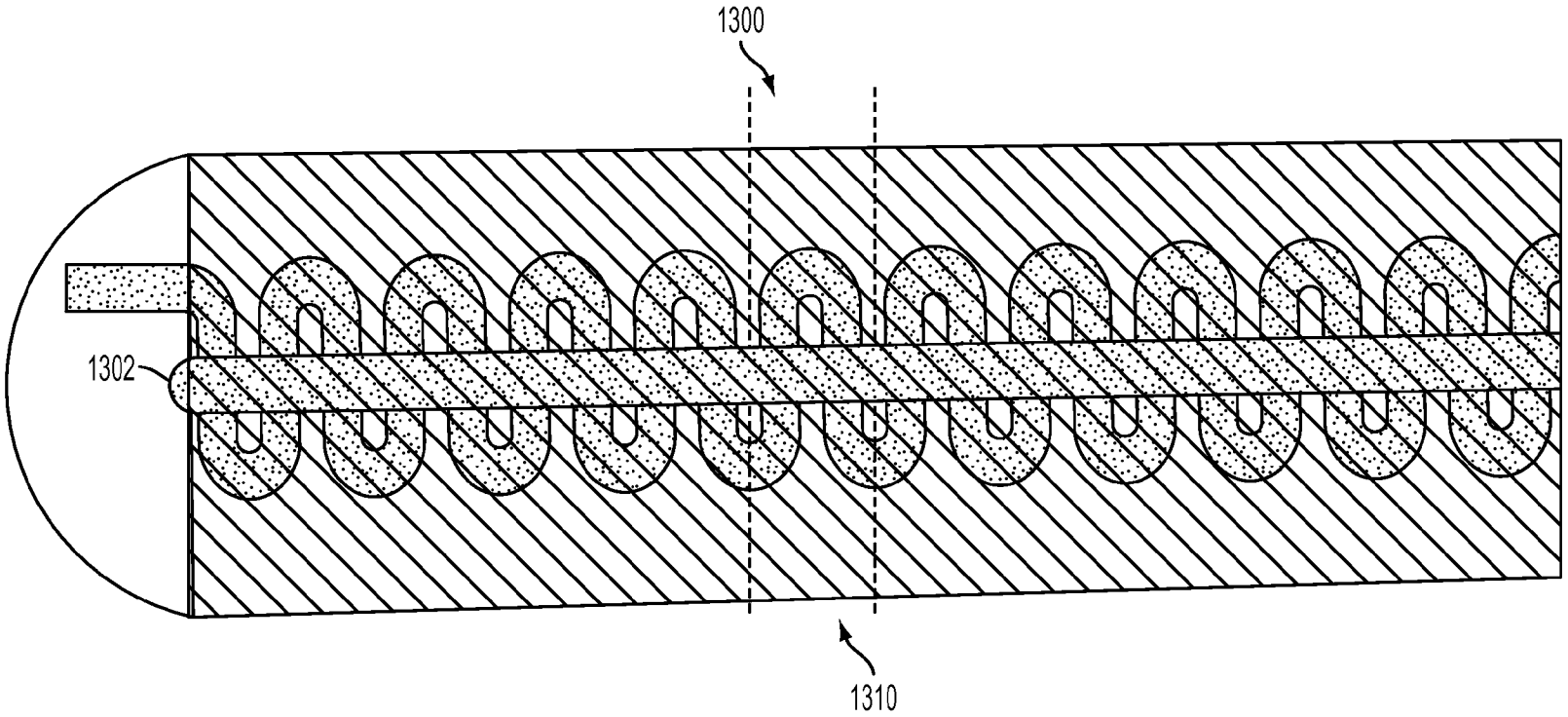
FIG. 14A illustrates one embodiment of an asymmetrical folded waveguide structure.
Figure 14B:
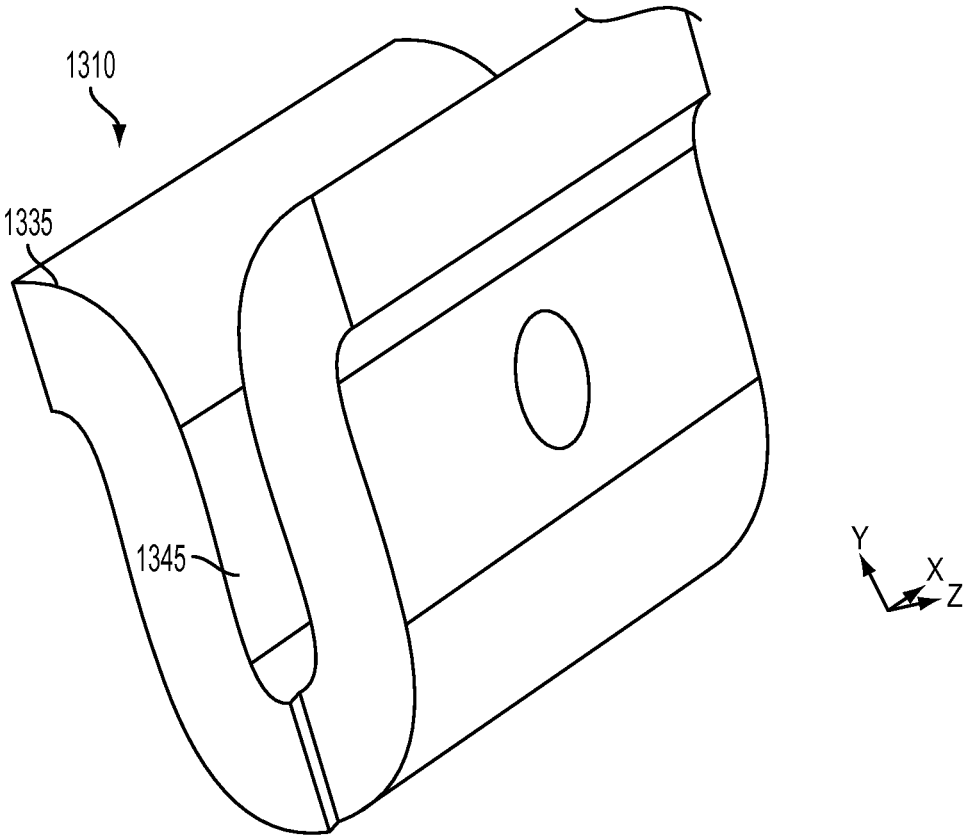
FIG. 14B illustrates one embodiment of an asymmetrical cell of the folded waveguide structure of FIG. 14A.

FIG. 14A illustrates one embodiment of an asymmetric folded waveguide 1300. The asymmetric folded waveguide 1300 is similar to the asymmetric waveguide 300 described above. The asymmetric folded waveguide 1300 comprises a plurality of asymmetric cells 1310 through which electron beam 1302 propagates. FIG. 14B illustrates one embodiment of a asymmetric cell 1310 of the asymmetric folded waveguide 1300 along axes X, Y, and Z. In some embodiments, the asymmetric cell may comprise a first wall 1335 and a second wall 1345. The distance between the first wall 1335 and the second wall 1345 may vary asymmetrically over the length of the asymmetric cell 1310. In one embodiment, the asymmetric folded waveguide 1300 may comprise one or more folds. The one or more folds may be any angle, for example, between 0° and 180°. In one embodiment, asymmetric folded waveguide structure may comprise one or more asymmetric folds.

Figure 15:
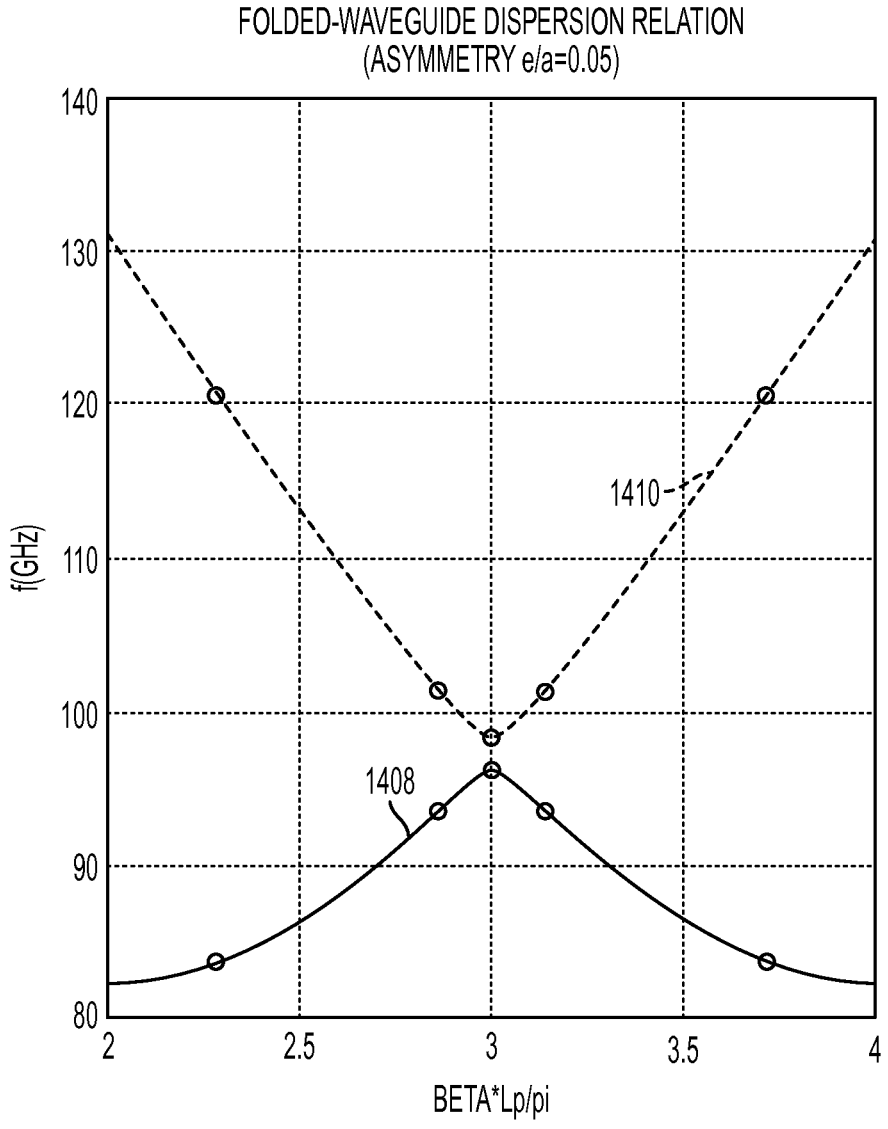
FIG. 15 illustrates one embodiment of a dispersion relation of the asymmetrical folded waveguide structure of FIG. 14A.

FIG. 15 illustrates one embodiment of the dispersion relation of the asymmetric folded waveguide 1300 (FIG. 14A). The horizontal axis represents BETA*Lp/pi, where BETA (β) is the circuit wave number, $L_p$ is the period length of the slow wave structure, and pi is π. The vertical axis represents frequency ("f") in gigahertz ("GHz"). The forward-wave segment of the first mode 1408 interacts with the electron beam 1302 (FIG. 14A) input into the asymmetric folded waveguide 1300 (FIG. 14A). The backward-wave segment of the first mode 1408 does not interact with the electron beam. The asymmetry of each cell 1310 (FIG. 14A) in the asymmetric folded waveguide 1300 (FIG. 14A) generates a band-gap at near the pi point between the first mode 1408 and the second mode 1410 of the asymmetric folded waveguide 1300 (FIG. 14A). The band gap prevents interaction between the backward-wave segment of the second mode 1410 and the electron beam as the backward-wave segment lacks a phase velocity component synchronous with the electron beam phase velocity. Because the band-gap eliminates interaction between the backward-wave segment of the second mode 1410 and the electron beam, the asymmetric folded waveguide 1300 (FIG. 14A) does not produce backward-wave oscillation.

Figure 16A:
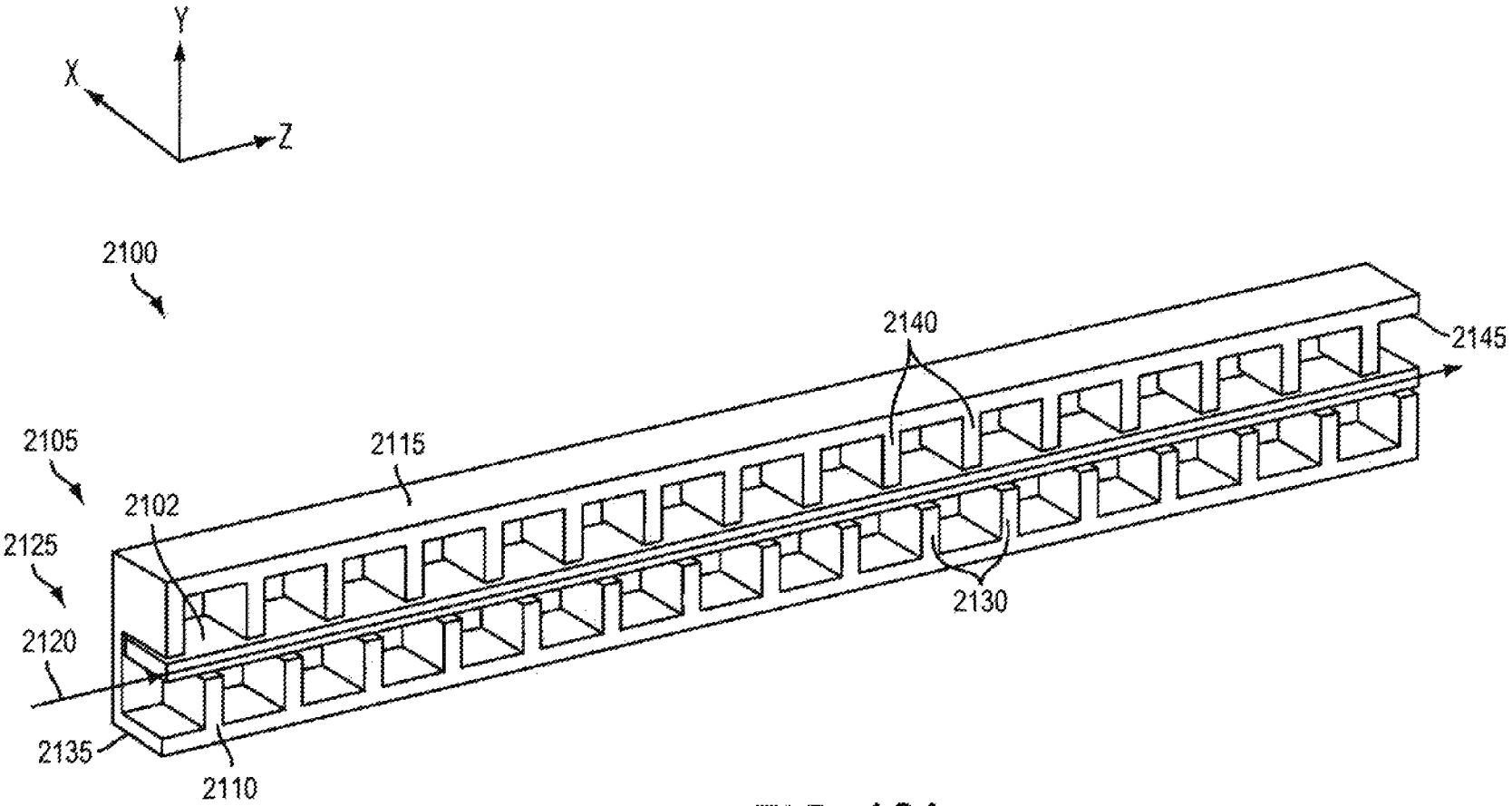
FIG. 16A illustrates a perspective cut-away side view of an electron sheet beam amplifier circuit according to one embodiment.
Figure 16B:
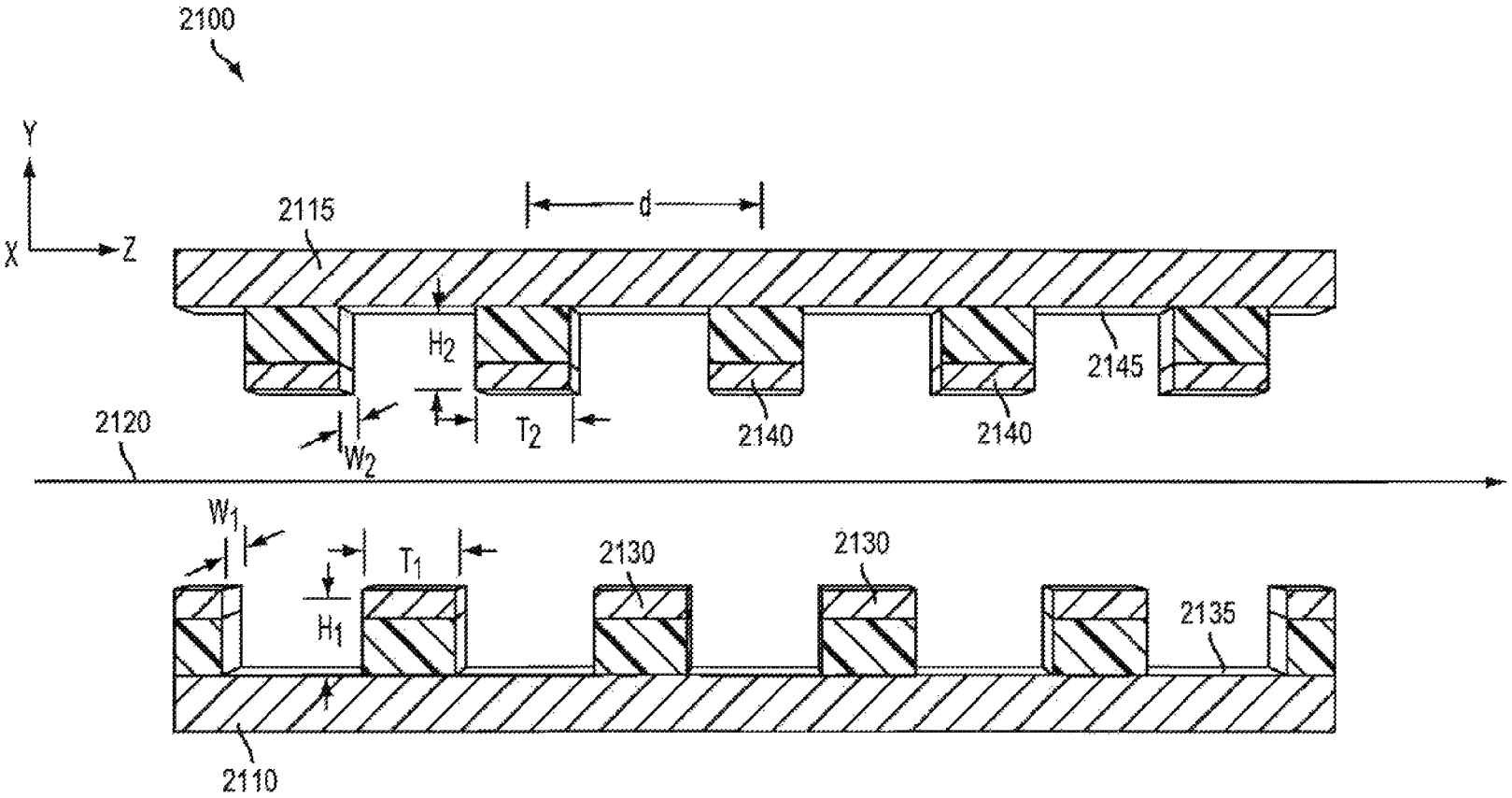
FIG. 16B illustrates a cross-sectional side view of a portion of the circuit of FIG. 16A.

FIG. 16A is a perspective cut-away side view of one embodiment of an electron sheet beam amplifier circuit. The circuit may comprise a slow wave structure (SWS) 2100 for slowing the wave velocity of an input RF wave to match the wave velocity of an input electron sheet beam 2102. The electron sheet beam may be generated using a suitable sheet beam electron gun, for example. Synchronous interaction between the velocity-matched RF wave and electron sheet beam effects a transfer of energy from the electron sheet beam to the RF wave, thus increasing the power of the input RF wave. FIG. 16B is a cross-sectional side view of a portion of the SWS 2100 of FIG. 16A shown along the Z-Y plane where the X axis is shown into the page and the Z-Y plane is shown on the page, configured to receive an electron sheet beam 2102. Additionally, the SWS 2100 is configurable to operate either as a compact narrowband high power and high gain amplifier (e.g., by virtue of a large interaction impedance between the SWS 2100 and an electron sheet beam passed therethrough), or as a wide band high power amplifier with extended dimensions (e.g., by virtue of a smaller interaction impedance between the SWS 2100 and an electron sheet beam passed therethrough). Various embodiments of the SWS 2100 are described below in connection with a high gain terahertz SWS configuration and a wide band millimeter wave SWS configuration.

Referring to FIG. 16A, the SWS 2100 may comprise a wave guide 2105 shown along axes X, Y, and Z comprising at least a first wall 2110 and a second wall 2115 opposite the first wall 2110. The first and second walls 2110, 2115 may be electrically conductive and connected (e.g., by electrically conductive third and fourth walls) to define an axis of propagation 2120 and a rectangular wave guide cross-section 2125 that is normal to the axis of propagation 2120. The SWS 2100 may further comprise a plurality of first projections 2130 located on an interior surface 2135 of the first wall 2110, with the first projections 2130 being distributed at a first pitch, or first period, in a direction of the axis of propagation 2120. The SWS 2100 may further comprise a plurality of second projections 2140 located on an interior surface 2145 of the second wall 2115 that is opposite the first wall 2110, with the second projections 2140 being distributed at a second pitch, or second period, in a direction of the axis of propagation 2120. As shown, a number of the second projections 2140 located on the interior surface 2145 of the second wall 2115 may be arranged in a staggered or alternating configuration in a direction of the axis of propagation 2120 relative to a number of corresponding first projections 2130 located on the interior surface 2135 of the first wall 2110. In other words, a portion of the second projections 2140 are alternatingly positioned with respect to a portion of corresponding first projections 2130 along the axis of propagation 2120. Advantageously, the staggered configuration allows the fundamental mode of the SWS 2100 to have a strong symmetric axial electric field distribution (e.g., in-phase field variation) along the axis of propagation 2120.

In certain embodiments, and as shown in FIG. 16A, each of the first projections 2130 may be in the form of a first vane 2130 substantially perpendicularly oriented relative to the interior surface 2135 of the first wall 2110, and each of the second projections 2140 may be in the form of a second vane 2140 substantially perpendicularly oriented relative to the interior surface 2145 of the second wall 2115. As shown in FIG. 16B, each first vane 2130 may define a substantially constant thickness $T_1$ measured in a direction of the axis of propagation 2120, a substantially constant height $H_1$ measured in a direction normal to the interior surface 2135 of the first wall 2110, and a substantially constant width $W_1$ measured in a direction transverse to the axis of propagation 2120. Similarly, each second vane 2140 may define a substantially constant thickness $T_2$ measured in a direction of the axis of propagation 2120, a substantially constant height $H_2$ measured in a direction normal to the interior surface 2145 of the second wall 2115, and a substantially constant width $W_2$ measured in a direction transverse to the axis of propagation 2120. According to various embodiments, either or both widths $W_1$ and $W_2$ of the vanes 2130, 2140, respectively, may be less than or substantially equal to the width of their corresponding interior surfaces 2135, 2145 (e.g., the width of the SWS 2100). In the embodiment of FIG. 3A, for example, widths $W_1$ and $W_2$ of the vanes 2130, 2140 are substantially equal to the widths of their corresponding interior surfaces 2135, 2145. For such embodiments, side surfaces of the vanes 2130, 2140 may terminate on side surfaces of the wave guide, for example.

In certain embodiments, the first projections 2130 and the second projections 2140 may have substantially identical shape and size. For example, with reference to the embodiment of FIGS. 16A and 16B, in which the first and second projections 2130, 2140 are in the form of vanes, the first vanes 2130 and the second vanes 2140 may be dimensioned such that $T_1$ is substantially equal to $T_2$, $H_1$ is substantially equal to $H_2$, and $W_1$ is substantially equal to $W_2$. In other embodiments, the first and second projections 2130, 2140 may comprise more than one size and/or shape. In certain embodiments, the first pitch of the first projections 2130 may be substantially equal to the second pitch of the second projections 2140. With reference to FIG. 16B, for example, both the first vanes 2130 and the second vanes 2140 may be distributed at period d in a direction of the axis of propagation 2120. Accordingly, the pitch of both the first vanes 2130 and the second vanes 2140 is equal to d (FIG. 16B).

In certain embodiments, the first pitch and the second pitch may remain constant for all first projections 2130 and all second projections 2140, respectively. For the sake of example and with reference to FIG. 16B, d may be a constant value of approximately 105 μm for all of the first projections 2130 and all of the second projections 2140. In other embodiments, the first and second pitches may co-vary uniformly in a direction of the axis of propagation 2120. Such variation in the first and second pitches may be used, for example, to compensate for a decrease in the energy of the electron sheet beam as it traverses the SWS 2100 in a direction of the axis of propagation 2120. In one such embodiment, the pitch variation may occur gradually over a length of the SWS 2100, while in another embodiment the pitch variation may be stepped such that contiguous regions of the SWS 2100 along the axis of propagation 2120 each have constant, but different, first and second pitch values.

Figure 17:
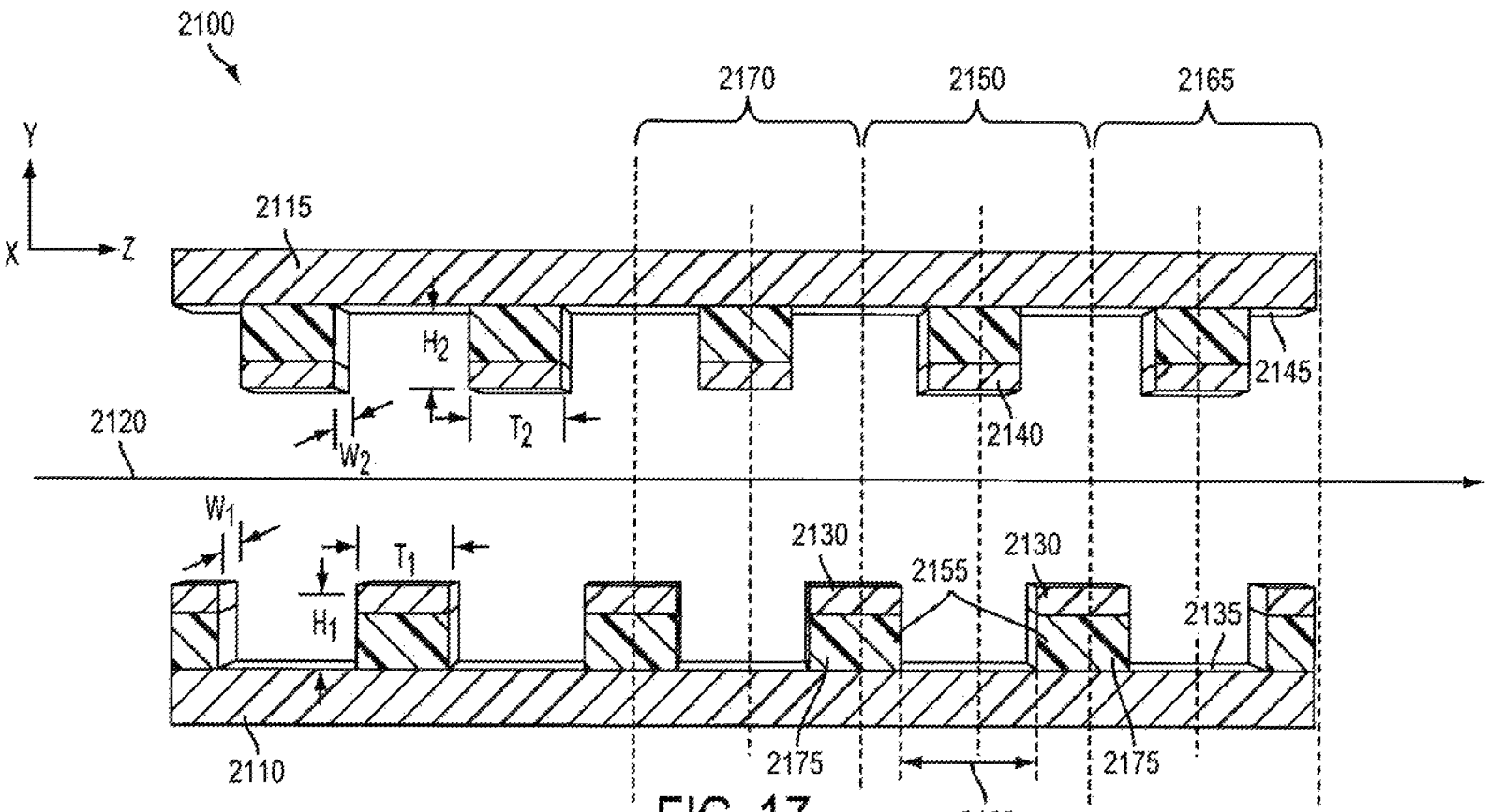
FIG. 17 illustrates a cell structure of the circuit of FIG. 16A according to one embodiment.

As shown in FIG. 16B, the staggered configuration of second projections 2140 located on the interior surface 2145 of the second wall 2115 may be such that a second projection 2140 symmetrically opposes a pair of adjacent first projections 2130 located on the interior surface 2135 of the first wall 2110. Accordingly, in embodiments in which the first pitch and the second pitch are equal, a number of the second projections 2140 will be effectively shifted along the axis of propagation 2120 by a distance equal to one-half of the pitch value to effect the staggered configuration. In other embodiments (not shown), the staggered configuration of second projections 2140 on the interior surface 2145 of the second wall 2115 may be such that each second projection 2140 of the staggered configuration asymmetrically opposes each of a pair of adjacent first projections 2130 located on the interior surface 2135 of the first wall 2110. By virtue of the alternating arrangement of a number of the second projections 2140 relative to a number of corresponding first projections 2130 along the axis of propagation 2120, it will be appreciated that embodiments of the SWS 2100 may be considered as an assemblage of adjacent cells distributed over a length of the wave guide 2105 in a direction of the axis of propagation 2120. FIG. 17 illustrates a first cell 2150 shown along the Z-Y plane where the X axis is shown into the page and the Z-Y plane is shown on the page according to one embodiment. The first cell 2150 of the SWS 2100 may comprise adjacent first portions 2155 of a pair of first projections 2130, with the first projections 2130 of the pair being adjacently located on the interior surface 2135 of the first wall 2110. The pair of first projections 2130 may be normal to the interior surface 2135 of the first wall 2110 and axially spaced along the axis of propagation 2120 to define a gap 2160. The first cell 2150 may further comprise a second projection 2140 located on the interior surface 2145 of the second wall 2115. The second projection 2140 may be normal to the interior surface 2145 of the second wall 2115 and axially positioned along the propagation axis 2120 such that the second projection 2140 is centrally located on a portion of the interior surface 2145 of the second wall 2115 that is opposite the gap 2160. Cells adjacent to the first cell 2150 may comprise portions of the pair of first projections 2130. For example, as shown in FIG. 17, second and third cells 2165, 2170 adjacent to the first cell 2150 may respectively comprise second portions 2175 of the pair of first projections 2130.

According to various embodiments, at least one of the first projections 2130 and the second projections 2140 may comprise a dielectric material and/or a metallic (e.g., an electrically conducting) material. In the embodiment shown in FIGS. 16B and 17, a first portion of each of the first and second projections 2130, 2140 that is adjacent to their respective interior surfaces 2135, 2145 may comprise a dielectric material, and a second portion of the first and second projections 2130, 2140 distally located with respect to their respective interior surfaces 2135, 2145 may comprise a metallic material. In other embodiments, each of the first and second projections 2130, 2140 may be constructed from a metallic material only. Suitable dielectric materials may include, for example, diamond and beryllium oxide, and suitable metallic materials may include, for example, copper, molybdenum or tungsten. The use of dielectric and/or metal materials to construct the first and second projections 2130, 2140 may be dictated at least in part by frequencies at which the SWS 2100 is intended to operate and heat dissipation considerations. For example, at high frequencies (e.g., hundreds of GHz), the RF ohmic losses on metallic surfaces of the SWS 2100 may be significant. Accordingly, embodiments of the SWS 2100 intended for operation at high frequencies may comprise first and second projections 2130, 2140 constructed of a combination of suitable dielectric and metal materials as shown in FIGS. 16B and 17. The particular dielectric material used in such embodiments may be selected based on its ability to withstand the heat generated by virtue of the interaction of the dielectric material with high frequency electrical fields. In embodiments in which ohmic losses may be tolerated, the first and second projections 2130, 2140 may be constructed from metallic material only. In certain embodiments, the SWS 2100 may comprise one or more first and second projections 2130, 2140 constructed of a combination of dielectric and metallic materials, as well as one or more first and second projections 2130, 2140 constructed from a metallic material only.

It is worthy to note that any reference to "one aspect," "an aspect," "one embodiment," or "an embodiment" means that a particular feature, structure, or characteristic described in connection with the aspect is included in at least one aspect. Thus, appearances of the phrases "in one aspect," "in an aspect," "in one embodiment," or "in an embodiment" in various places throughout the specification are not necessarily all referring to the same aspect. Furthermore, the particular features, structures or characteristics may be combined in any suitable manner in one or more aspects.

Some aspects may be described using the expression "coupled" and "connected" along with their derivatives. It should be understood that these terms are not intended as synonyms for each other. For example, some aspects may be described using the term "connected" to indicate that two or more elements are in direct physical or electrical contact with each other. In another example, some aspects may be described using the term "coupled" to indicate that two or more elements are in direct physical or electrical contact. The term "coupled," however, also may mean that two or more elements are not in direct contact with each other, but yet still co-operate or interact with each other.

Although various embodiments have been described herein, many modifications, variations, substitutions, changes, and equivalents to those embodiments may be implemented and will occur to those skilled in the art. Also, where materials are disclosed for certain components, other materials may be used. It is therefore to be understood that the foregoing description and the appended claims are intended to cover all such modifications and variations as falling within the scope of the disclosed embodiments. The following claims are intended to cover all such modification and variations.

All of the above-mentioned U.S. patents, U.S. patent application publications, U.S. patent applications, foreign patents, foreign patent applications, non-patent publications referred to in this specification and/or listed in any Application Data, Sheet, or any other disclosure material are incorporated herein by reference, to the extent not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Although various embodiments have been described herein, many modifications, variations, substitutions, changes, and equivalents to those embodiments may be implemented and will occur to those skilled in the art. Also, where materials are disclosed for certain components, other materials may be used. It is therefore to be understood that the foregoing description and the appended claims are intended to cover all such modifications and variations as falling within the scope of the disclosed embodiments. The following claims are intended to cover all such modification and variations.

In summary, numerous benefits have been described which result from employing the concepts described herein. The foregoing description of the one or more embodiments has been presented for purposes of illustration and description. It is not intended to be exhaustive or limiting to the precise form disclosed. Modifications or variations are possible in light of the above teachings. The one or more embodiments were chosen and described in order to illustrate principles and practical application to thereby enable one of ordinary skill in the art to utilize the various embodiments and with various modifications as are suited to the particular use contemplated. It is intended that the claims submitted herewith define the overall scope.

What is claimed is:

1. A traveling wave amplifier circuit to receive an RF wave and an electron beam and to effect synchronized interaction therebetween, the circuit comprising:

a waveguide comprising a plurality of asymmetric cells arranged periodically along an axis of propagation, wherein the waveguide is configured to receive an electron beam along the axis of propagation, and wherein each asymmetric cell comprises at least one asymmetrical structure within the asymmetric cell to modify the dispersion relation of the waveguide to prevent backward-wave oscillation in the waveguide, wherein the at least one asymmetrical structure is asymmetric along the axis of propagation.

2. The traveling wave amplifier circuit of claim 1, wherein the at least one asymmetrical structure comprises a dimension of the waveguide, wherein the dimension of the waveguide varies asymmetrically over each asymmetric cell.

3. The traveling wave amplifier circuit of claim 2, wherein the waveguide comprises:

a helical structure, wherein each of the plurality of asymmetric cells comprises:
- a pitch angle;
- an azimuth; and
- a radius; and wherein at least one of the pitch angle, the azimuth, and the radius varies asymmetrically.

4. The traveling wave amplifier circuit of claim 3, wherein each of the plurality of asymmetric cells comprises a plurality of vanes, wherein the plurality of vanes are arranged asymmetrically along the azimuth of the helical structure.

5. The traveling wave amplifier of circuit of claim 1, wherein the waveguide comprises:

a coupled-cavity structure, wherein each of the plurality of asymmetric cells comprises:
- a first resonant cavity; and
- a second resonant cavity;
- wherein the first resonant cavity and the second resonant cavity are asymmetrical.

6. The traveling wave amplifier circuit of claim 1, wherein the waveguide comprises:

a ring-bar structure, wherein each of the plurality of asymmetric cells comprises:
- a first ring having a first radius;
- a second ring having a second radius;
- a first bar coupling the first ring and the second ring;
- a second bar extending from the first ring away from the second ring; and
- a third bar extending from the second ring away from the first ring, wherein at least one of the first radius, the second radius, the first bar, the second bar, or the third bar varies asymmetrically.

7. The traveling wave amplifier circuit of claim 1, wherein the waveguide comprises:

a folded waveguide, wherein each of the plurality of asymmetric cells comprises:
- a first wall and a second wall opposite the first wall, wherein the first wall and the second wall are connected to define the axis of propagation and a rectangular cross-section that is normal to the axis of propagation, and wherein the axis of propagation comprises at least one fold, wherein the fold causes a change in a direction of an axis of propagation of the folded waveguide.

8. The traveling wave amplifier circuit of claim 1, wherein the asymmetric structure comprises a plurality of vanes extending from an interior surface of the waveguide, wherein the plurality of vanes are arranged asymmetrically within each cell.

9. The traveling wave amplifier circuit of claim 8, wherein the plurality of vanes comprise a metal material.

10. The traveling wave amplifier circuit of claim 8, wherein the plurality of vanes comprise a composite stack of a dielectric material and a metal material.

11. The traveling wave tube amplifier of claim 1, wherein the waveguide comprises:

a plurality of first projections located on and extending from an interior surface of a first wall, wherein the plurality of first projections is pitched in a direction of the axis of propagation;

a plurality of second projections located on and extending from an interior surface of a second wall, wherein the plurality of second projections is pitched in the direction of the axis of propagation;

wherein a number of the plurality of second projections is located on and extending from the interior surface of the second wall in a staggered configuration in the direction of the axis of propagation relative to a number of corresponding ones of the plurality of first projections located on and extending from the interior surface of the first wall; and wherein each second projection of the staggered configuration asymmetrically opposes a pair of adjacent first projections located on the interior surface of the first wall.

12. The traveling wave amplifier circuit of claim 1, wherein the electron beam comprises a circular electron beam.

13. A traveling wave tube amplifier comprising:

a waveguide comprising a plurality of asymmetric cells arranged periodically along an axis of propagation, wherein the waveguide is configured to receive an electron beam along the axis of propagation, and wherein each asymmetric cell of the plurality of asymmetric cells comprises at least one asymmetrical structure therein, thereby forming a plurality of asymmetrical structures along the axis of propagation to modify the dispersion relation of the waveguide, wherein each of the plurality of asymmetrical structures is asymmetric along the axis of propagation;

an electron beam input device configured to generate an electron beam in the waveguide, wherein the waveguide is configured to slow a wave velocity of an input radiofrequency beam to match an input velocity of the electron beam, and wherein the asymmetrical structure is configured to eliminate the backward wave oscillation of the radiofrequency beam within the waveguide.

14. The traveling wave tube amplifier of claim 13, wherein the waveguide comprises:

a plurality of first projections located on and extending from an interior surface of a first wall, wherein the plurality of first projections is pitched in a direction of the axis of propagation;

a plurality of second projections located on and extending from an interior surface of a second wall, wherein the plurality of second projections is pitched in the direction of the axis of propagation;

wherein a number of the plurality of second projections is located on and extending from the interior surface of the second wall in a staggered configuration in the direction of the axis of propagation relative to a number of corresponding ones of the plurality of first projections located on and extending from the interior surface of the first wall; and wherein each second projection of the staggered configuration asymmetrically opposes a pair of adjacent first projections located on the interior surface of the first wall.

15. The traveling wave tube amplifier of claim 13, wherein the waveguide comprises:

a folded-waveguide, wherein each of the plurality of asymmetric cells comprises:

a first wall and a second wall opposite the first wall, wherein the first wall and the second wall are connected to define an axis of propagation of the folded waveguide and a rectangular cross-section that is normal to the axis of propagation, and wherein the axis of propagation comprises at least one fold, wherein the fold causes a change in a direction of the axis of propagation of the folded waveguide.

16. The traveling wave tube amplifier of claim 13, wherein the at least one asymmetrical structure comprises a dimension of the waveguide, wherein the dimension of the waveguide varies asymmetrically over each asymmetric cell.

17. The traveling wave tube amplifier of claim 16, wherein the waveguide comprises:

a helical structure, wherein each of the plurality of asymmetric cells comprises:

a pitch angle;

an azimuth; and a radius; and wherein at least one of the pitch angle, the azimuth, and the radius varies asymmetrically.

18. The traveling wave tube amplifier of claim 13, wherein the waveguide comprises:

a coupled-cavity structure, wherein each of the plurality of asymmetric cells comprises:

a first resonant cavity; and a second resonant cavity;

wherein the first resonant cavity and the second resonant cavity are asymmetrical.

19. The traveling wave tube amplifier of claim 13, wherein the waveguide comprises:

a ring-bar structure, wherein each of the plurality of asymmetric cells comprises:

a first ring having a first radius;

a second ring having a second radius;

a first bar coupling the first ring and the second ring;

a second bar extending from the first ring away from the second ring; and a third bar extending from the second ring away from the first ring, wherein at least one of the first radius, the second radius, the first bar, the second bar, or the third bar varies asymmetrically.

* * * * *